US005491975A

United States Patent [19]

Yamashita et al.

[11] Patent Number: 5,491,975

[45] Date of Patent: Feb. 20, 1996

[54] AIR-FUEL RATIO CONTROL SYSTEM FOR INTERNAL COMBUSTION ENGINE

[75] Inventors: Yukihiro Yamashita, Kariya, Japan; Kenji Ikuta, Rolling Hills Estates, Calif.; Shigenori Isomura, Kariya, Japan

[73] Assignee: Nippondenso Co., Ltd., Kariya, Japan

[21] Appl. No.: 85,379

[22] Filed: Jul. 2, 1993

[30] Foreign Application Priority Data

Jul. 3, 1992 [JP] Japan ..... 4-177226
Oct. 28, 1992 [JP] Japan ..... 4-290341

[51] Int. Cl.[6] ..... F01N 3/28
[52] U.S. Cl. ..... 60/276; 60/285
[58] Field of Search ..... 60/285, 276

[56] References Cited

U.S. PATENT DOCUMENTS 5,090,199 2/1992 Ikuta ..... 60/277
5,115,639 5/1992 Gopp ..... 60/285

FOREIGN PATENT DOCUMENTS 1110853 4/1989 Japan .
2238147 9/1990 Japan .
3185244 8/1991 Japan .
3217633 9/1991 Japan .
3253714 11/1991 Japan ..... 60/277
2242544 10/1991 United Kingdom .

*Primary Examiner*—Douglas Hart
*Attorney, Agent, or Firm*—Cushman, Darby & Cushman

[57] ABSTRACT

In an air-fuel ratio control system for an internal combustion engine, a target air-fuel ratio is set on a side opposite to a direction of deviation of a monitored upstream side air-fuel ratio in such a manner as to counterbalance or offset the deviation of the upstream side air-fuel ratio. The deviation of the upstream side air-fuel ratio may be derived in the form of an mount of a particular component adsorbed in a catalytic converter. A learned value may be used to correct the monitored upstream side air-fuel ratio. Further, a monitored downstream side air-fuel ratio may be used to monitor the setting of the target air-fuel ratio.

12 Claims, 25 Drawing Sheets

START
1401
λRL<λ(i)<λLL ?
NO
1403
XOSAR=1
CCNT←0
YES
1402
XOSAR=1 ?
NO
YES
CCNT←CCNT+1
1404
1405
CCNT>1sec ?
NO
YES
1406
VOX2<VLL ?
NO
YES (LEAN)
1412
VOX2≧VRL ?
NO
YES (RICH)
XOSTR=1
1413
λTG←λTG-ΔλR
1407
λTG←λTG+ΔλL
1414
C
1408
XOSTR=1 ?
YES (RICH)
NO (LEAN)
1409
VOX2≧VLL ?
NO
C
1415
VOX2<VRL ?
NO
C
YES
λTG←λTG+ΔλR
1410
YES
λTG←λTG-ΔλL
1416
XOSTR=0
1417
XOSAR=0
1411
RET

AIR-FUEL RATIO CONTROL SYSTEM FOR INTERNAL COMBUSTION ENGINE

BACKGROUND OF THE INVENTION

1. Field of the Invention

The present invention relates generally to an air-fuel ratio control system for an internal combustion engine, and more specifically, to the air-fuel ratio control system, wherein an air-fuel ratio feedback control is performed based on an output from a sensor which is provided on the upstream side of a catalytic converter in an exhaust passage for monitoring the exhaust gas passing therethrough to detect an air-fuel ratio of an air-fuel mixture which has caused the monitored exhaust gas.

Hereinafter, for simplification of explanation, the expression "air-fuel ratio" will be used to represent not only "an air-fuel ratio of an air-fuel mixture to be fed to the engine", but also other meanings where the context allows. For example, the expression "air-fuel ratio" will also represent "an air-fuel ratio indicative or related condition of the monitored exhaust gas" or "a converted value of an air-fuel ratio", depending on the context.

2. Description of the Prior Art

Japanese First (unexamined) Patent Publication No. 2-238147 discloses an air-fuel ratio control system for an internal combustion engine of the above-noted type.

In the system of this publication, oxygen concentration sensors (hereinafter referred to as "$O_2$ sensors") are respectively arranged on the upstream and downstream sides of a catalytic converter. When it is determined based on an output voltage of the upstream $O_2$ sensor that an air-fuel ratio of the exhaust gas is deviated or fluctuated to a rich or lean side with respect to a stoichiometric air-fuel ratio, an air-fuel ratio correction coefficient is corrected by a preset integral amount in a direction opposite to that of the deviation. Further, when the monitored air-fuel ratio is inverted from rich to lean or from lean to rich across the stoichiometric air-fuel ratio, the air-fuel ratio correction coefficient is corrected in a skipped manner by a skip amount which is set to a value greater than the integral amount, in a direction opposite to that of the deviation, so as to converge the actual air-fuel ratio to the stoichiometric air-fuel ratio. Moreover, when the output voltage of the downstream $O_2$ sensor largely fluctuates beyond a preset rich side limit value or a preset lean side limit value, the skip amount is increased so as to largely correct the air-fuel ratio correction coefficient for completing the correction of the air-fuel ratio as quickly as possible.

Japanese First (unexamined) Patent Publication No. 3-185244 or U.S. Pat. No. 5,090,199 which is equivalent thereto, discloses another air-fuel ratio control system for an internal combustion engine.

In the system of this publication, an air-fuel ratio sensor is arranged upstream of a catalytic converter, and an $O_2$ sensor is arranged downstream of the catalytic converter. When it is determined based on the output voltage of the $O_2$ sensor that an air-fuel ratio of the exhaust gas is deviated to a rich or lean side with respect to the stoichiometric air-fuel ratio, the target air-fuel ratio is corrected by a preset value in a direction opposite to that of the deviation so as to converge the actual air-fuel ratio to the stoichiometric air-fuel ratio.

However, the foregoing conventional systems have the following disadvantages, respectively:

In either of the foregoing conventional systems, although the actual air-fuel ratio is controlled to be converged to near the stoichiometric air-fuel ratio as described above, no consideration is made with respect to an adsorbing condition of the harmful components in the exhaust gas to the catalytic converter. Specifically, as is known, as components in the exhaust gas, when the air-fuel ratio is deviated to the lean side, nitrogen oxide NOx and oxygen $O_2$ are increased, on the other hand, when the air-fuel ratio is deviated to the rich side, carbon monoxide CO and hydrocarbon HC are increased. When the deviation of the air-fuel ratio is not so large, these harmful components are adsorbed in the catalytic converter so as to be prevented from emitting into the atmosphere. In the foregoing correction in the conventional systems, even when the air-fuel ratio is converged to the stoichiometric air-fuel ratio, it is possible that the harmful components remain in the catalytic converter to some extent. However, when the harmful components remain in the catalytic converter, the adsorption capability of the catalytic converter for the harmful components is decreased correspondingly, that is, tolerance against the deviation of the air-fuel ratio is decreased. As a result, when, for example, a vehicle repeats acceleration and deceleration to frequently deviate the air-fuel ratio, the harmful components remaining in the catalytic converter gradually increase so that the purification of the exhaust gas becomes insufficient thereby allowing emission of the harmful components into the atmosphere.

SUMMARY OF THE INVENTION

Therefore, it is an object of the present invention to provide an improved air-fuel ratio control system for an internal combustion engine that can eliminate the foregoing disadvantage inherent in the conventional air-fuel ratio control systems.

To accomplish the above-mentioned and other objects, according to one aspect of the present invention, an air-fuel ratio control system for an internal combustion engine comprises air-fuel ratio detecting means, provided upstream of a catalytic converter in an exhaust passage Of the engine, for detecting an air-fuel ratio of an air-fuel mixture based on exhaust gas upstream of the catalytic converter; deviation condition determining means for determining a deviation condition of the detected air-fuel ratio when the air-fuel ratio is deviated to a rich side or a lean side; target air-fuel ratio setting means, based on the deviation condition of the air-fuel ratio determined by the deviation condition determining means, for setting a target air-fuel ratio on a side opposite to a direction of the deviation of the air-fuel ratio in such a manner as to counterbalance the deviation; and fuel injection amount adjusting means for adjusting a fuel injection amount of a fuel injection valve based on the target air-fuel ratio which is set by the target air-fuel ratio setting means.

According to another aspect of the present invention, an air-fuel ratio control system for an internal combustion engine comprises air-fuel ratio detecting means, provided upstream of a catalytic converter in an exhaust passage of the engine, for detecting an air-fuel ratio of an air-fuel mixture based on exhaust gas upstream of the catalytic converter; deviation condition determining means for determining whether the detected air-fuel ratio exceeds a preset rich side limit value or a preset lean side limit value; target air-fuel ratio setting means, based on the deviation condition of the air-fuel ratio determined by the deviation condition determining means, for setting a target air-fuel ratio to a lean side target value which is leaner than a stoichiometric air-fuel ratio when the air-fuel ratio exceeds said rich side limit value and to a rich side target value which is richer than the stoichiometric air-fuel ratio when the air-fuel ratio exceeds the lean side limit value; and fuel injection amount adjusting means for adjusting a fuel injection amount of a fuel injection valve based on the target air-fuel ratio which is set by the target air-fuel ratio setting means.

According to still another aspect of the present invention, an air-fuel ratio control system for an internal combustion engine comprises downstream side air-fuel ratio detecting means, provided downstream of a catalytic converter in an exhaust passage of the engine, for detecting an air-fuel ratio of an air-fuel mixture based on exhaust gas having passed through the catalytic converter; target air-fuel ratio setting means for determining a deviation direction of the detected downstream side air-fuel ratio with respect to a stoichiometric air-fuel ratio, and for setting a target air-fuel ratio on a side opposite to the deviation direction, the target air-fuel ratio setting means restoring the target air-fuel ratio to a value before the setting based on an approaching condition of the detected downstream side air-fuel ratio toward the stoichiometric air-fuel ratio after the setting; and fuel injection amount adjusting means for adjusting a fuel injection amount of a fuel injection valve based on the target air-fuel ratio which is set by the target air-fuel ratio setting means.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to be limitative of the present invention.

In the drawings.

DESCRIPTION OF THE PREFERRED EMBODIMENT

Now, preferred embodiments of the present invention will be described hereinbelow with reference to the accompanying drawings.

Figure 1:
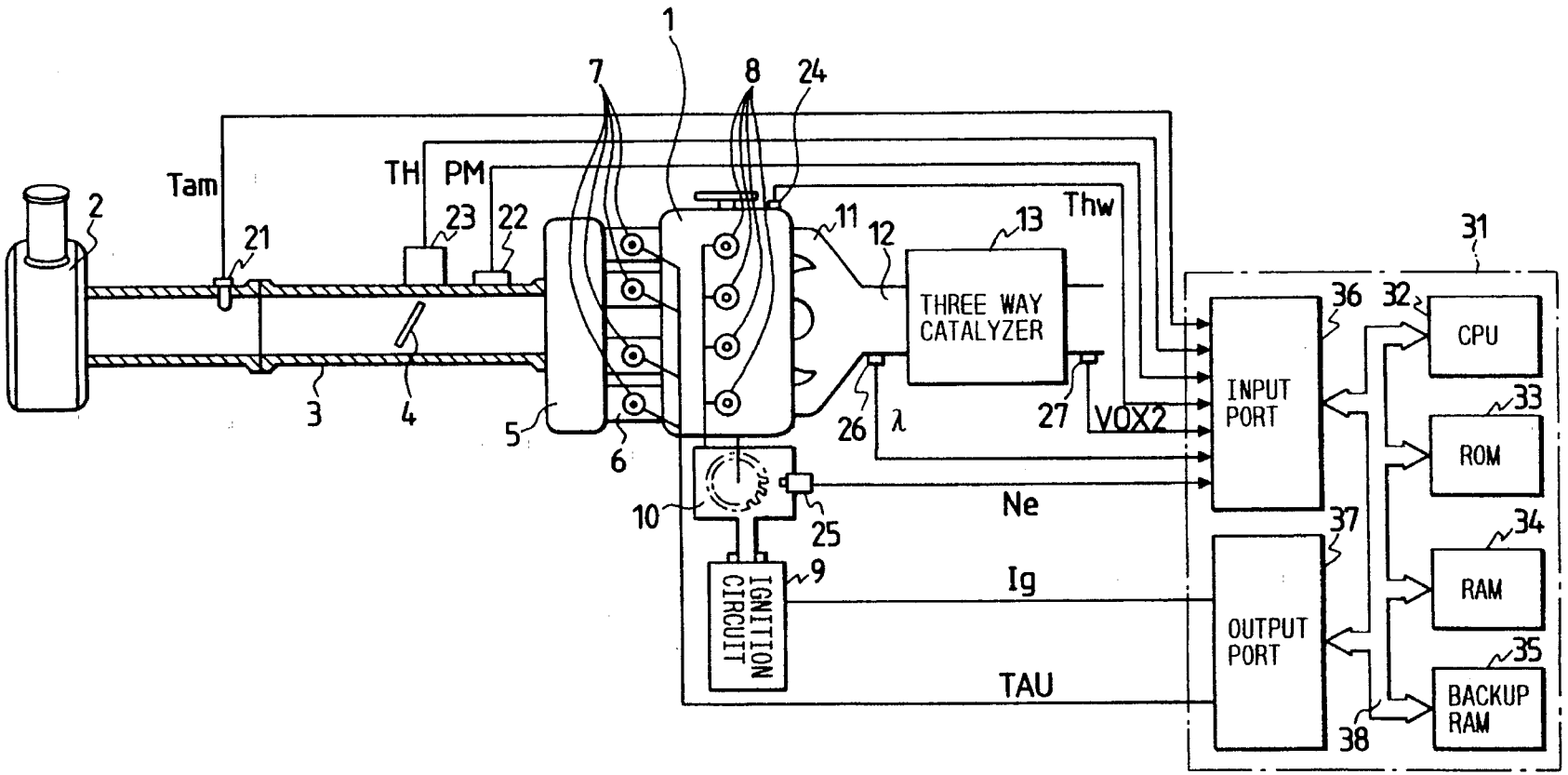
FIG. 1 is a schematic diagram showing an entire structure of an air-fuel ratio control system for an internal combustion engine according to a first preferred embodiment of the present invention.

FIG. 1 is a schematic structural diagram of an internal combustion engine and its peripheral devices, incorporating an air-fuel ratio control system according to a first preferred embodiment of the present invention.

In FIG. 1, the engine 1 is of a spark ignition type of four cylinders and four cycles. Intake air is introduced from the upstream via an air cleaner 2, an intake pipe 3, a throttle valve 4, a surge tank 5 and an intake manifold 6. In the intake manifold 6, the intake air is mixed with a fuel injection valve 7 provided for each engine cylinder so as to form an air-fuel mixture of a given air-fuel ratio, which is then fed to the corresponding engine cylinder. To a spark plug 8 for each engine cylinder, a high voltage supplied from an ignition circuit 9 is distributed by a distributor 10 for igniting the mixture gas in each engine cylinder at a given timing. Exhaust gas after combustion is discharged via an exhaust manifold 11 and an exhaust pipe 12. A three-way catalytic converter 13 is arranged in the exhaust pipe 12 for purifying harmful components such as CO, HC and NOx contained in the exhaust gas from the engine cylinders.

An intake air temperature sensor 21 and an intake air pressure sensor 22 are respectively provided in the intake pipe 3. The intake air temperature sensor 21 monitors an intake air temperature Tam upstream of the throttle valve 4, and the intake air pressure sensor 22 monitors an intake air pressure PM downstream of the throttle valve 4. A throttle sensor 23 is further provided for outputting an analog signal indicative of an opening degree of the throttle valve 4. The throttle sensor 23 also outputs an on/off signal from an idle switch (not shown), which is indicative of whether the throttle valve 4 is almost fully closed or not. A coolant temperature sensor 24 is mounted to an engine cylinder block for monitoring a temperature Thw of an engine cooling water. A speed sensor 25 is further prodded in the distributor 10 for monitoring an engine speed Ne. The speed sensor 25 produces twenty-four (24) pulses per 720° CA (crank angle), i.e. per two rotations of an engine crankshaft. Further, an air-fuel ratio sensor (hereinafter referred to as "A/F sensor") 26 is arranged in the exhaust pipe 12 upstream of the three-way catalytic converter 13. The A/F sensor 26 monitors the exhaust gas discharged from the engine cylinders so as to produce a linear signal corresponding to an air-fuel ratio λ (excess air ratio) of the air-fuel mixture which has caused the monitored exhaust gas. An $O_2$ sensor 27 is further provided in the exhaust pipe downstream of the three-way catalytic converter 13. The $O_2$ sensor 27 monitors the exhaust gas having passed through the three way catalytic converter 13 to produce an output voltage VOX2 depending on whether an air-fuel ratio λ of the air-fuel mixture which has caused the monitored exhaust gas is rich or lean with respect to a stoichiometric air-fuel ratio λ=1.

An electronic control unit (hereinafter referred to as "ECU") 31 for controlling operating conditions of the engine 1 is formed as an arithmetic logic operation circuit mainly comprising a CPU 32, a ROM 33, a RAM 34, a backup RAM 35 and the like which are connected to an input port 36, an output port 37 and the like via a bus 38. The input port 36 is for inputting detection signals from the foregoing sensors, and the output port 37 is for outputting control signals to actuators for controlling operations thereof. Specifically, the ECU 31 receives via the input port 36 the detection signals representative of the intake air temperature Tam, the intake air pressure PM, the throttle opening degree TH, the cooling water temperature Thw, the engine speed Ne, the air-fuel ratio signal, the output voltage VOX2 and the like from the foregoing sensors. The ECU 31 calculates a fuel injection amount TAU and an ignition timing Ig based on these input signals and outputs the respective control signals to the fuel injection valves and the ignition circuit 9 via the output port 37 for controlling the operations thereof. Among these controls, the air-fuel ratio control for deriving the fuel injection amount TAU will be described hereinbelow.

The ECU 31 has been designed by the following method in order to execute the air-fuel ratio control. The designing method, which will be explained hereinbelow, is disclosed in Japanese First (unexamined) Patent Publication No. 64-110853.

Modeling of an Object to be controlled

In this embodiment, as a model of a system for controlling the air-fuel ratio λ of the engine 1, an autoregressive moving average model of degree 1 having a dead time P=3 is used, and is further approximated in consideration of a disturbance d.

First, the mode of the system for controlling the air-fuel ratio λ using the autoregressive moving average model can be approximated by the following equation (1):

$$\lambda(k)=a\cdot\lambda(k-1)+b\cdot FAF(k-3) \tag{1}$$

wherein, λ: air-fuel ratio, FAF: air-fuel ratio correction coefficient, a, b: constants, k: variable indicative of the number of control times from the start of a first sampling Further, when the disturbance d is considered, the model of the control system can be approximated by the following equation (2):

$$\lambda(k)=a\cdot\lambda(k-1)+b\cdot FAF(k-3)+d(k-1) \tag{2}$$

For the models thus approximated, it is easy to obtain the constants a and b by discretion based on rotation synchronous (360° CA) samplings using a step response, that is, to obtain a transfer function G of the system which controls the air-fuel ratio λ.

Display Method of a State Variable Amount X

By rewriting the above equation (2) using a state variable amount $X(k)=[X_1(k), X_2(k), X_3(k), X_4(k)]^T$, the following equation (3) is obtained:

$$\begin{pmatrix} X_1(k+1) \\ X_2(k+1) \\ X_3(k+1) \\ X_4(k+1) \end{pmatrix} = \begin{pmatrix} a & b & 0 & 0 \\ 0 & 0 & 1 & 0 \\ 0 & 0 & 0 & 1 \\ 0 & 0 & 0 & 0 \end{pmatrix} \begin{pmatrix} X_1(k) \\ X_2(k) \\ X_3(k) \\ X_4(k) \end{pmatrix} + \begin{pmatrix} 0 \\ 0 \\ 0 \\ 1 \end{pmatrix} FAF(k) + \begin{pmatrix} 1 \\ 0 \\ 0 \\ 0 \end{pmatrix} d(k) \tag{3}$$

Then, we have $$\begin{aligned} X_1(k+1) &= aX_1(k) + bX_2(k) + d(k) = \lambda(k+1) \\ X_2(k+1) &= FAF(k-2) \\ X_3(k+1) &= FAF(k-1) \\ X_4(k+1) &= FAF(k) \end{aligned} \tag{4}$$

Designing of a Regulator

Now, a regulator is designed. By using an optimum feedback gain $K=[K_1, K_2, K_3, K_4]$ and the state variable mount $X^T(k)=[\lambda(k), FAF(k-3), FAF(k-2), FAF(k-1)]$, the following equation (5) is obtained:

$$\begin{aligned} FAF(k) &= K\cdot X^T(k) \\ &= K_1\cdot\lambda(k) + K_2\cdot FAF(k-3) + \\ &\quad K_3\cdot FAF(k-2) + \\ &\quad K_4\cdot FAF(k-1) \end{aligned} \tag{5}$$

Further, an integration term $Z_1(k)$ for absorbing errors is added to obtain the following equation (6):

$$\begin{aligned} FAF(k) &= K_1\cdot\lambda(k) + \\ &\quad K_2\cdot FAF(k-3) + \\ &\quad K_3\cdot FAF(k-2) + \\ &\quad K_4\cdot FAF(k-1) + Z_1(k) \end{aligned} \tag{6}$$

In this manner, the air-fuel ratio λ and the correction coefficient FAF can be derived.

The integration term $Z_1(k)$ is a value determined by a deviation between a target air-fuel ratio λTG and an actual air-fuel ratio λ(k) and by an integration constant Ka, and is derived by the following equation (7):

$$Z_1(k)=Z_1(k-1)+Ka\cdot(\lambda TG-\lambda(k)) \quad (7)$$

Figure 2:
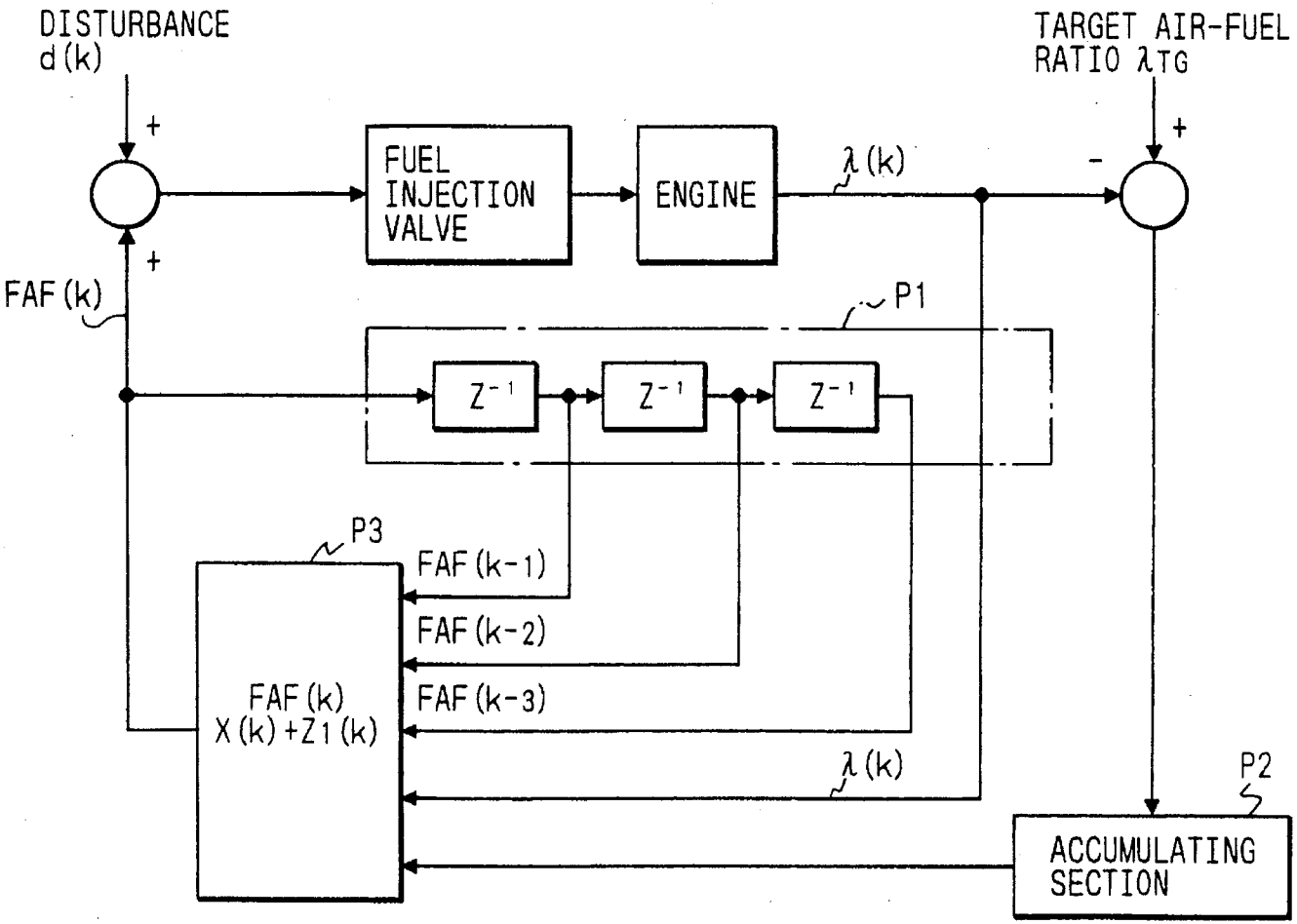
FIG. 2 is a block diagram for explaining the principle of the air-fuel ratio control according to the first preferred embodiment.

FIG. 2 is a block diagram of the system having the model designed in the foregoing manner for controlling the air-fuel ratio λ. As shown in FIG. 2, the $Z^{-1}$ transformation is used to derive the air-fuel ratio correction coefficient FAF(k) from the previous air-fuel ratio correction coefficient FAF(k−1). The previous air-fuel ratio correction coefficient FAF(k−1) has been stored in the RAM 34 and is read out in a next control timing for deriving a new value of the air-fuel ratio correction coefficient FAF(k).

In FIG. 2, block P1 surrounded by a one-dot chain line represents a section which determines the state variable amount X(k) in a state where the air-fuel ratio λ is feedback controlled to the target air-fuel ratio λTG. Block P2 represents an accumulating section for deriving the integration term $Z_1(k)$. Block P3 represents a section which calculates a current value of the air-fuel ratio correction coefficient FAF(k) based on the state variable amount X(k) determined at the block P1 and the integration term $Z_1(k)$ derived at the block P2.

Determination of the optimum Feedback Gain K and the Integration Constant Ka

The optimum feedback gain K and the integration constant Ka can be set, for example, by minimizing an evaluation function J as represented by the following equation (8):

$$J=\sum_{k=0}^{\infty}\{Q(\lambda(k)-\lambda TG)^2+R(FAF(k)-FAF(k-1))^2\} \quad (8)$$

The evaluation function J intends to minimize the deviation between the actual air-fuel ratio λ(k) and the target air-fuel ratio λTG, while restricting motion of the air-fuel ratio correction coefficient FAF(k). A weighting of the restriction to the air-fuel ratio correction coefficient FAF(k) can be variably set by values of weight parameters Q and R. Accordingly, the optimum feedback gain K and the integration constant Ka are determined by changing the values of the weight parameters Q and R to repeat various simulations until the optimum control characteristics are attained.

Further, the optimum feedback gain K and the integration constant Ka depend on the model constants a and b. Accordingly, in order to ensure the stability (robust performance) of the system against fluctuation (parameter fluctuation) of the system which controls the actual air-fuel ratio λ, the optimum feedback gain K and the integration constant Ka should be set in consideration of fluctuation amounts of the model constants a and b. For this reason, the simulations are performed taking into account the fluctuation of the model constants a and b which can be practically caused, so as to determine the optimum feedback gain K and the integration constant Ka which satisfy the stability.

The ECU 31 has been designed beforehand in the manner as described above. Accordingly, the ECU 31 practically performs the air-fuel ratio control using only the foregoing equations (6) and (7).

Now, details of the air-fuel ratio control will be described hereinbelow.

Figure 3:
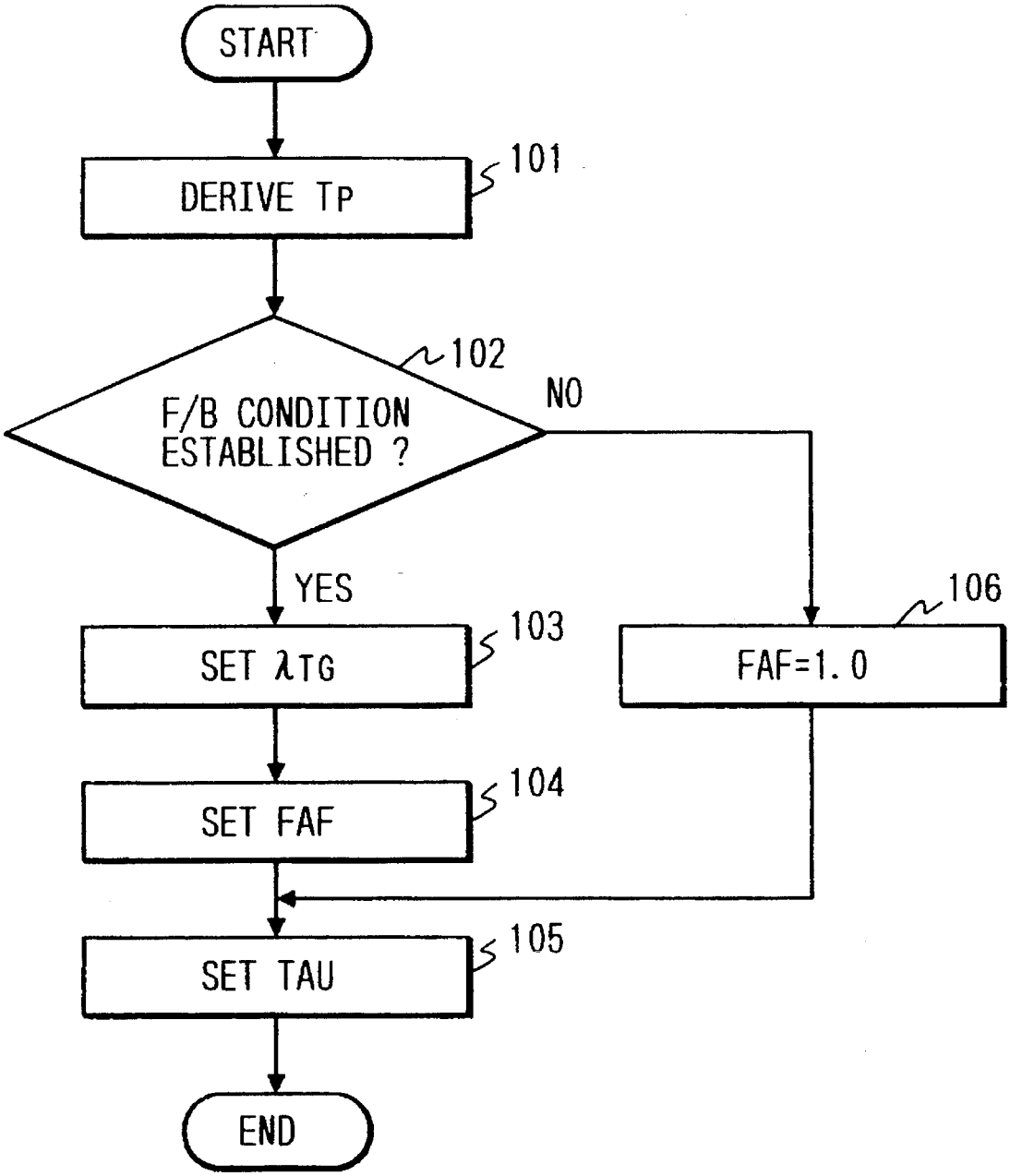
FIG. 3 is a flowchart of a fuel injection amount deriving routine according to the first preferred embodiment.

FIG. 3 is a flowchart showing a main routine to be executed by the CPU 32 for deriving the fuel injection amount TAU.

This routine is executed synchronously with engine rotation, i.e. per 360° CA (crank angle). At a first step 101, a basic fuel injection mount Tp is derived based on, such as, the intake air pressure PM and the engine speed Ne. Subsequently, a step 102 determines whether or not a feedback (F/B) control condition for the air-fuel ratio λ is established. As is well known in the art, the feedback control condition is established when the cooling water temperature Thw is higher than a preset value and when the engine is not at a high speed and under a high load. If the step 102 determines that the feedback control condition is established, the target air-fuel ratio λTG is set at a step 103, which will be described later in detail, and the air-fuel ratio correction coefficient FAF is set at a step 104 for converging the air-fuel ratio λ to the target air-fuel ratio λTG. Specifically, at the step 104, the air-fuel ratio correction coefficient FAF is derived based on the target air-fuel ratio λTG and the air-fuel ratio λ(k) detected by the A/F sensor 26, using the foregoing equations (6) and (7). Subsequently, the routine proceeds to a step 105. On the other hand, if the step 102 determines that the feedback control condition is not established, the air-fuel ratio correction coefficient FAF is set to a value "1", and the routine proceeds to the step 105.

At the step 105, the fuel injection amount TAU is set based on the basic fuel injection amount Tp, the air-fuel ratio correction coefficient FAF and another known correction coefficient FALL, using the following equation:

$$TAU=Tp\times FAF\times FALL$$

A control signal is then produced based on the thus set fuel injection mount TAU and supplied to the fuel injection valve 7 for controlling a valve opening time, that is, an actual fuel injection mount to be supplied via the fuel injection valve 7. As a result, the air-fuel ratio λ of the mixture gas is adjusted to the target air-fuel ratio λTG.

Now, a subroutine, corresponding to the step 103 in FIG. 3, for deriving the target air-fuel ratio λTG will be described in detail.

In this preferred embodiment, the target air-fuel ratio λTG is set in different manners depending on operating conditions of the engine 1. Specifically, the engine operating conditions are classified into a steady driving condition where, for example, a vehicle is running at a constant speed with the engine speed Ne, the intake air pressure PM and the like being held substantially constant, and a transitional driving condition where the vehicle is under acceleration with the engine speed Ne, the intake air pressure PM and the like being fluctuating and where the air-fuel ratio λ is deviated from the stoichiometric air-fuel ratio λ=1 to a certain degree. Accordingly, a routine for determining the steady driving condition or the transitional driving condition will be described hereinbelow.

Figure 4:
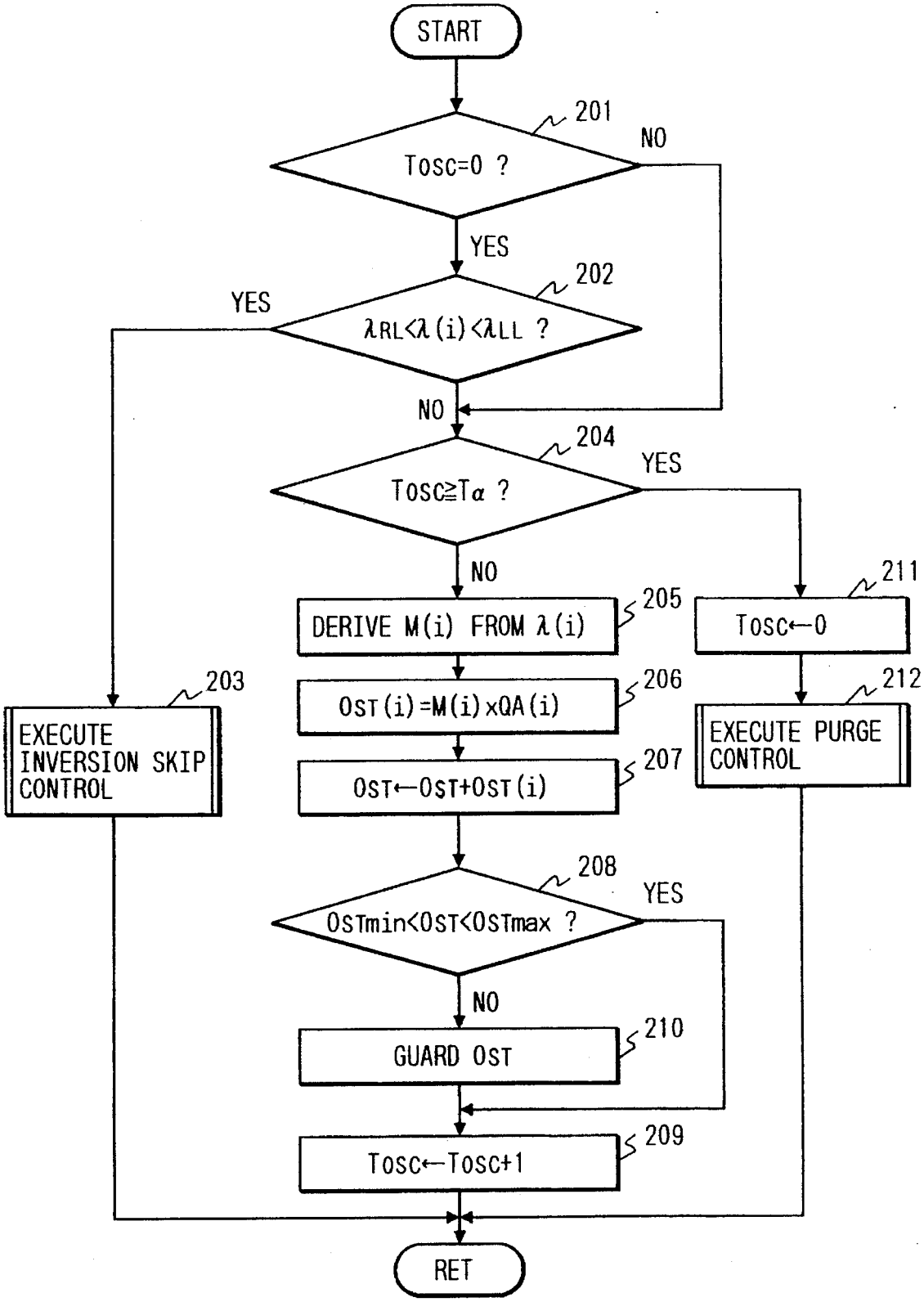
FIG. 4 is a flowchart of a routine for determining whether the engine is under a steady driving condition or a transitional driving condition, according to the first preferred embodiment.

FIG. 4 is a flowchart of the routine for determining whether the engine is under the steady driving condition or the transitional driving condition.

Figure 6:
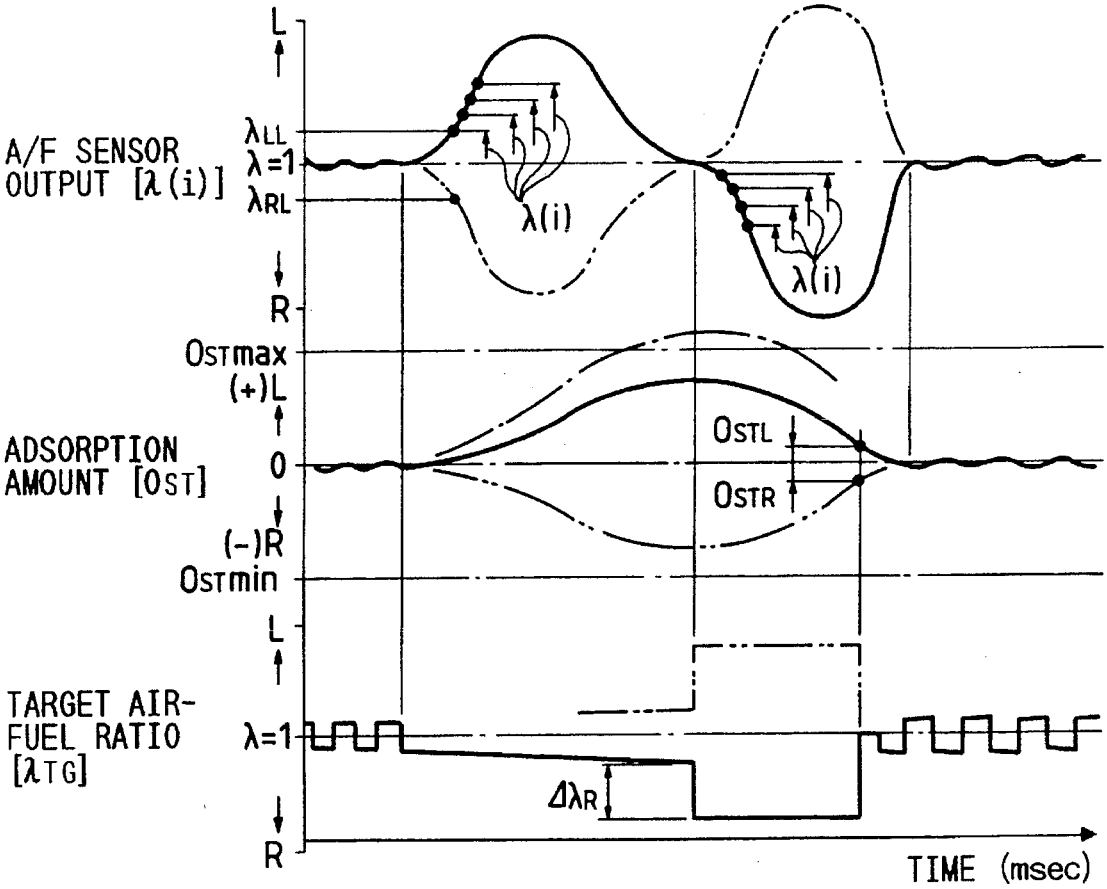
FIG. 6 is a time chart showing a relation among an output of an air-fuel ratio sensor disposed upstream of a three-way catalytic converter, an adsorption amount of the three-way catalytic converter and a target air-fuel ratio.

At a first step 201, the CPU 32 determines whether or not an adsorption mount deriving counter TOSC is reset, i.e. whether its value is 0 (zero). If answer at the step 201 is YES, a step 202 checks whether the air-fuel ratio λ monitored by the A/F sensor 26 is converged in a rage between a preset rich limit value λRL and a preset lean limit value λLL, wherein λRL<λ=1<λLL. At the step 202, λ(i) is used since the air-fuel ratio λ is sampled successively as shown in FIG. 6. If answer at the step 202 is YES, i.e. the monitored air-fuel ratio λ(i) is within the given rage so that the engine 1 can be determined under the steady driving condition, a step 203 executes an inversion skip control. As will be described later in detail, this inversion skip control is performed for holding the actual air-fuel ratio λ near the stoichiometric air-fuel ratio λ=1.

On the other hand, if answer at the step 202 is NO, i.e. the air-fuel ratio λ(i) is not within the given range defined by the preset rich and lean limit values λRL and λLL so that the engine 1 can be determined under the transitional driving condition, the routine proceeds to a step 204. The step 204 judges whether the value of the counter TOSC has reached a preset sapling time Tα. Since the counter TOSC is reset as determined at the step 201, the step 204 produces a negative answer so that the routine proceeds to a step 205.

Figure 5:
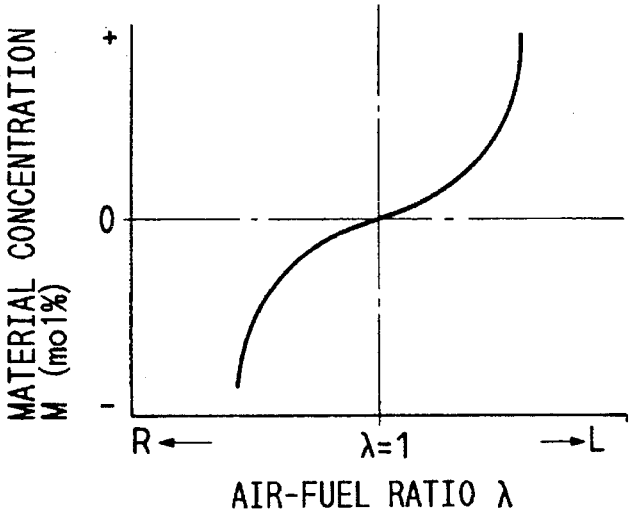
FIG. 5 is a map prestored in a ROM for deriving a material concentration based on an air-fuel ratio.

At the step 205, a current material concentration M(i) is derived based on the air-fuel ratio λ(i) monitored by the A/F sensor 26, using a map in FIG. 5 prestored in the ROM 33. As is well known, as the harmful components in the exhaust gas, NOx and $O_2$ are increased when the air-fuel ratio λ deviates to the lean side with respect to the stoichiometric air-fuel ratio k=0, while CO and HC are increased when the air-fuel ratio λ deviates to the rich side. On the other hand, since the map in FIG. 5 defines the material concentration M in terms of $O_2$ in this preferred embodiment, the material concentration M is set as a positive value on the lean side as representing an excess of $O_2$, while, is set as a negative value on the rich side as representing a shortage of $O_2$ required by CO and HC.

After deriving the material concentration M(i) at the step 205, the routine proceeds to a step 206 where an adsorption mount OST(i) of $O_2$ adsorbed to or stored in the three-way catalytic converter 13 is derived from the derived material concentration M(i) and an intake air quantity QA(i) using the following equation:

$$OST(i)=M(i)\times QA(i)$$

In this equation, in consideration of an air-flow delay in the engine 1, the intake air quantity QA(i) represents a value corresponding to the air flow which provides the air-fuel ratio λ(i) from which the material concentration M(i) is derived at the step 205. Specifically, as is well known in the art, the intake air quantity QA(i) is derived based on the engine speed Ne and the intake air pressure PM. However, since the speed sensor 25 for monitoring the engine speed Ne and the intake air pressure sensor 22 for monitoring the intake air pressure PM are respectively arranged upstream of the A/F sensor 26 for monitoring the air-fuel ratio λ(i), a value detected 1.5 times before (that is, a mean value of the current and last values) is applied for the engine speed Ne, and a value detected 3 times before is applied for the intake air pressure PM. Accordingly, the intake air quantity QA(i) is derived from the following equation:

$$QA(i)\propto Ne(I-1.5)\times PM(I-3)$$

After deriving the adsorption amount OST(i) at the step 206, the routine proceeds to a step 207 where a total adsorption mount OST is derived by OST←OST+OST(i). Subsequently, a step 208 determines whether the total adsorption amount OST derived at the step 207 is within a rage defined by a preset minimum adsorption mount OSTmin and a preset maximum adsorption mount OSTmax. Here, the minimum adsorption amount OSTmin represents a maximum adsorption amount of the three-way catalytic converter 13 for CO and HC when the air-fuel ratio λ is on the rich side with respect to the stoichiometric air-fuel ratio. As described before, since the adsorption amount is defined in terms of $O_2$, the maximum adsorption amount for CO and HC takes a negative value so as to be defined as "the minimum adsorption amount OSTmin". On the other hand, the maximum adsorption amount OSTmax represents a maximum adsorption amount of the three-way catalytic converter 13 for $O_2$ when the air-fuel ratio λ is on the lean side. As is known, the absolute values of these minimum and maximum adsorption amounts OSTmin and OSTmax, respectively, are decreased as the deterioration of the three-way catalytic converter 13 advances. The minimum and maximum adsorption mounts OSTmin and OSTmax are updated by a later described adsorption amount learning control so that the newest data is used at the step 208.

When the step 208 determines that the current total adsorption mount OST is between the minimum and maximum adsorption amounts OSTmin and OSTmax, the routine proceeds to a step 209 where the counter TOSC is counted up by a value "1", and then returns to the step 201. Since the value of the counter TOSC is not 0 (zero) this time, the routine proceeds to the step 204 bypassing the step 202. The step 204 checks whether the value of the counter TOSC has reached the sampling time Tα. If answer at the step 204 is again negative, the steps 205 to 207 derive a current value of the adsorption amount OST(i) from a current value of the monitored air-fuel ratio λ(i) and further derive a current value of the total adsorption amount OST by adding the current value of the adsorption mount OST(i) to the last value of the total adsorption mount OST. Accordingly, this process continues until the sapling time Tα has elapsed.

Although the deviated air-fuel ratio λ is gradually restored to the stoichiometric air-fuel ratio λ=1, the sapling time Tα is preset to be longer than a time period expected to be required for the normal restoration of the air-fuel ratio λ to the stoichiometric air-fuel ratio. Accordingly, the adsorption amount OST(i) continues to be sampled until the air-fuel ratio λ is restored to the stoichiometric air-fuel ratio. As a result, the total adsorption mount OST accumulated by the adsorption amounts OST(i) represents a total mount of the harmful components (that is, NOx at the deviation to the lean side and CO and HC at the deviation to the rich side) which have been adsorbed to or stored in the three-way catalytic converter 13 due to the deviation of the air-fuel ratio λ toward the lean or rich side with respect to the stoichiometric air-fuel ratio.

On the other hand, when the total adsorption mount OST exceeds the range between the minimum and maximum adsorption mounts OSTmin and OSTmax as indicated by a one-dot chain line in FIG. 6, the step 208 produces a negative answer so that the total adsorption amount OST is guarded by the minimum and maximum adsorption mounts OSTmin and OSTmax at a subsequent step 210. Specifically, when the total adsorption mount OST exceeds the range between the minimum and maximum adsorption amounts OSTmin and OSTmax, it is considered that the three-way catalytic converter 13 has been saturated on the rich or lean side so as not to adsorb the harmful components, such as, CO, HC and NOx any more. This means that those harmful components are emitted from the three-way catalytic converter 13 so that the absolute values of the minimum and maximum adsorption amounts OSTmin and OSTmax do not increase any more. In this regard, the minimum adsorption amount OSTmin represents a saturated adsorption amount of the three-way catalytic converter 13 on the rich side, and the maximum adsorption mount OSTmax represents a saturated adsorption amount of the three-way catalytic converter 13 on the lean side. Accordingly, at the step 210, the total adsorption mount OST is set to the minimum adsorption amount OSTmin when it becomes equal to or smaller than the minimum adsorption amount OSTmin, on the other hand, the total adsorption mount OST is set to the maximum adsorption mount OSTmax when it becomes equal to or greater than the maximum adsorption mount OSTmax.

Referring back to the step 204, when the value of the counter TOSC has reached the sapling time Tα, the routine proceeds to a step 211 where the counter TOSC is reset to 0 (zero), and further proceeds to a step 212 where a purge control is performed. As will be described later in detail, the purge control is performed based on the total adsorption amount OST derived as described above, for eliminating the harmful components adsorbed by the three-way catalytic converter 13.

Now, the inversion skip control executed at the steady driving condition will be described hereinbelow.

Figure 7:
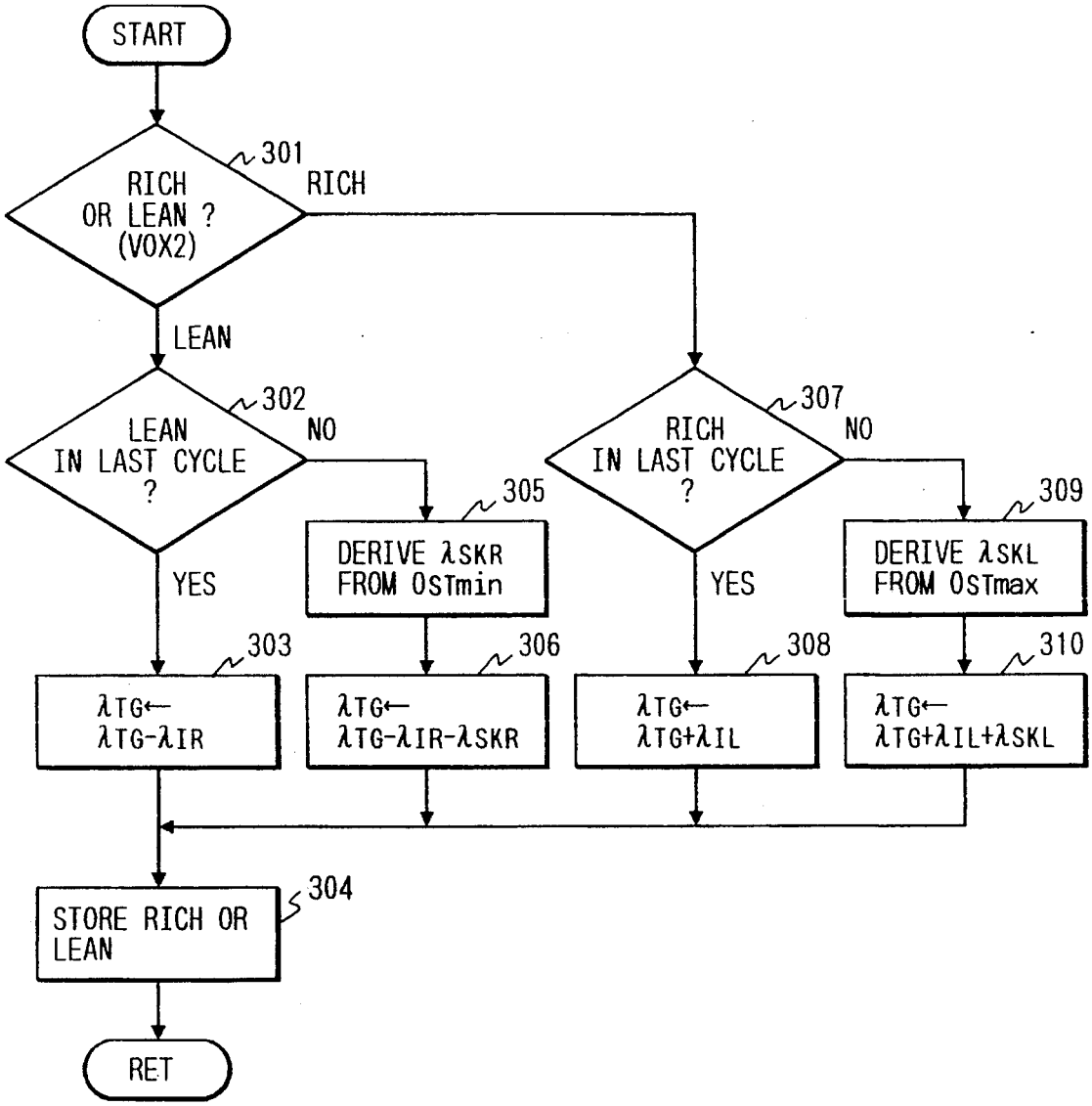
FIG. 7 is a flowchart of an inversion skip control routine according to the first preferred embodiment.

FIG. 7 is a flowchart showing a routine of the inversion skip control, which is a subroutine corresponding to the step 203 in FIG. 4.

Figure 8:
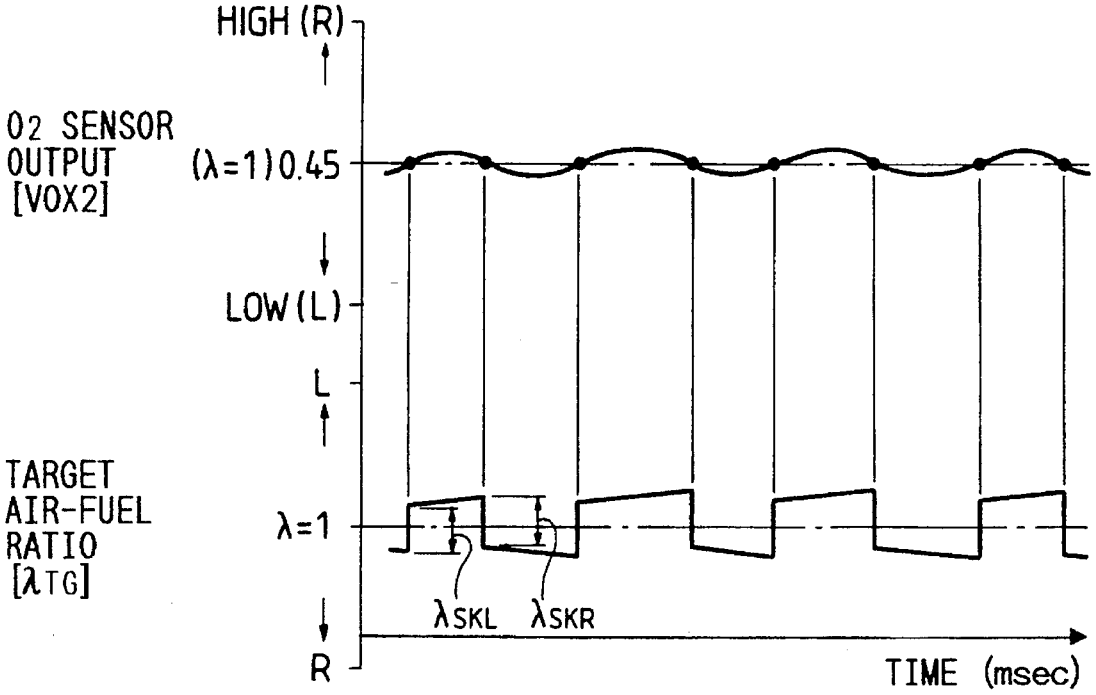
FIG. 8 is a time chart showing a relation between an output of an $O_2$ sensor downstream of the three-way catalytic converter and the target air-fuel ratio during the inversion skip control of FIG. 7.

At a first step 301, the CPU 32 determines whether the output voltage VOX2 of the $O_2$ sensor 27 is higher (rich) or lower (lean) than 0.45 V which represents a value corresponding to the stoichiometric air-fuel ratio $\lambda=1$. If "lean" is determined, then the routine proceeds to a step 302 where it is checked whether or not answer at the step 301 was lean in the last cycle of this routine. The step 302 determines this based on rich/lean data stored at a step 304 which stores such rich/lean data per execution of this routine. If answer at the step 302 is positive, i.e. the air-fuel ratio $\lambda$ is held on the lean side, then a step 303 corrects the target air-fuel ratio $\lambda TG$ to be a richer value ($\lambda TG \leftarrow \lambda TG - \lambda IR$, wherein $\lambda IR$ represents a rich integral amount), that is, the target air-fuel ratio $\lambda TG$ is corrected in a direction opposite to that of the deviation of the air-fuel ratio $\lambda$ with respect to the stoichiometric air-fuel ratio. Subsequently, at the step 304, "lean" is stored in the RAM 34 as a polarity of the air-fuel ratio $\lambda$. Since the rich integral amount $\lambda IR$ is set to be a very small value, the target air-fuel ratio $\lambda TG$ gradually decreases on the rich side as shown in FIG. 8.

Figure 9:
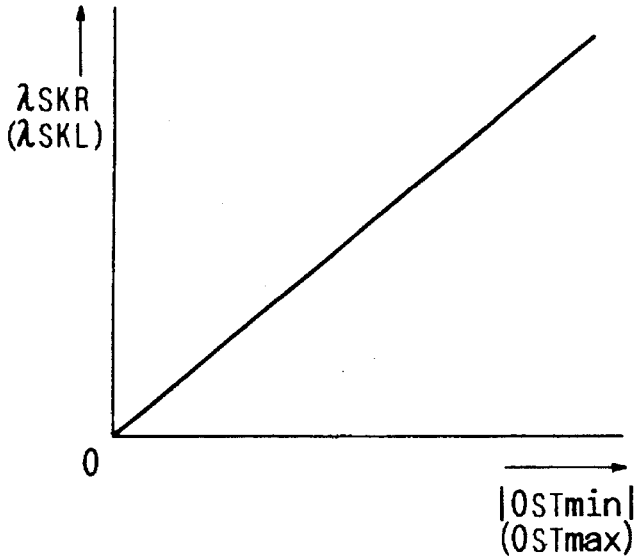
FIG. 9 is a map prestored in the ROM for deriving a skip amount from a minimum or maximum adsorption amount of the three-way catalytic converter.

On the other hand, if answer at the step 302 is negative, i.e. "rich" is stored at the step 304 in the last cycle of this routine so that the inversion of the air-fuel ratio $\lambda$ from rich to lean across the stoichiometric air-fuel ratio $\lambda=1$ has been occurred, the routine proceeds to a step 305 where a rich skip amount $\lambda SKR$ is derived based on a current value of the minimum adsorption amount OSTmin, using a map in FIG. 9 prestored in the ROM 33. As described before, the minimum adsorption amount OSTmin is updated by the later described adsorption mount learning control. As seen in FIG. 9, a magnitude of the rich skip amount $\lambda SKR$ is directly proportional to the absolute value of the minimum adsorption mount OSTmin. Accordingly, as the absolute value of the minimum adsorption amount OSTmin decreases due to the deterioration of the three-way catalytic converter 13, the rich skip amount $\lambda SKR$ is set to be smaller. Subsequently, a step 306 corrects the target air-fuel ratio to be a richer value ($\lambda TG \leftarrow \lambda TG - \lambda IR - \lambda SKR$), that is, the target air-fuel ratio $\lambda TG$ is corrected in a direction opposite to that of the deviation of the air-fuel ratio $\lambda$ with respect to the stoichiometric air-fuel ratio. Subsequently, at the step 304, "lean" is stored in the RAM 34 as a polarity of the air-fuel ratio $\lambda$. Since the rich skip mount $\lambda SKR$ is a sufficiently large value in comparison with the rich integral mount $\lambda IR$, the target air-fuel ratio $\lambda TG$ rapidly and largely drops in a skipped manner from lean to rich across the stoichiometric air-fuel ratio $\lambda=1$, as shown in FIG. 8.

Referring back to the step 301, if "rich" is determined, a step 307 determines whether the air-fuel ratio $\lambda$ was rich in the last cycle of this routine, as executed at the step 302. If answer at the step 307 is positive, then the routine proceeds to a step 308 where the target air-fuel ratio $\lambda TG$ is gradually increased by a lean integral mount $\lambda IL$ ($\lambda TG \leftarrow \lambda TG + \lambda IL$) on the lean side. On the other hand, if answer at the step 307 is negative, i.e. the air-fuel ratio $\lambda$ was lean in the last cycle of this routine so that the inversion of the air-fuel ratio $\lambda$ from lean to rich has been caused, the routine proceeds to a step 309 where a lean skip amount $\lambda SKL$ is derived from the maximum adsorption mount OSTmax using the map of FIG. 9. Subsequently, a step 310 rapidly and largely increases the target air-fuel ratio $\lambda TG$ in a skipped manner from rich to lean, i.e. across the stoichiometric air-fuel ratio $\lambda=1$, by the lean skip amount $\lambda SKL$ ($\lambda TG \leftarrow \lambda TG + \lambda IL + \lambda SKL$). As in case of the foregoing rich skip mount $\lambda SKR$, as the maximum adsorption amount OSTmax is decreased due to the deterioration of the three-way catalytic converter 13, the lean skip amount $\lambda SKL$ is set to be smaller. From the step 308 or the step 310, the routine proceeds to the step 304 where "rich" is stored in the RAM 34 as a polarity of the air-fuel ratio $\lambda$.

As is known, the internal combustion engine, including the three-way catalytic converter 13, is the system which basically represents a large delay. Accordingly, in case the air-fuel ratio of the air-fuel mixture is controlled by the fuel injection valve 7 at the induction side, a certain time is required before its control result is reflected on the output voltage VOX2 of the $O_2$ sensor 27 on the exhaust side. For this reason, when the output voltage VOX2 is inverted between rich and lean, the air-fuel ratio $\lambda$ to be detected thereafter already includes a factor of large deviation toward the rich or lean side. Accordingly, the delicate correction performed by the rich or lean integral amount $\lambda IR$ or $\lambda IL$ can not effectively suppress the deviation of the air-fuel ratio $\lambda$. However, in the inversion skip control as described above, since the target air-fuel ratio $\lambda TG$ is corrected by the sufficiently large rich or lean skip amount $\lambda SKR$ or $\lambda SKL$ in a skipped manner at the inversion of the output voltage VOX2, the air-fuel ratio $\lambda$ is not largely deviated, but is held near the stoichiometric air-fuel ratio $\lambda=1$ with the slight deviation thereacross, under the steady driving condition.

Further, as seen from FIG. 9 and as described above, when the saturated adsorption amount (OSTmin, OSTmax) is decreased due to the deterioration of the three-way catalytic converter 13, the rich or lean skip amount $\lambda SKR$, $\lambda SKL$ is also derived to be a smaller value. Accordingly, the excess correction beyond the adsorption limit of the three-way catalytic converter 13, which causes emission of the harmful components, is effectively prevented.

Now, the purge control to be executed when the air-fuel ratio $\lambda$ is deviated to a certain extent at the transitional driving condition, will be described hereinbelow.

Figure 10:
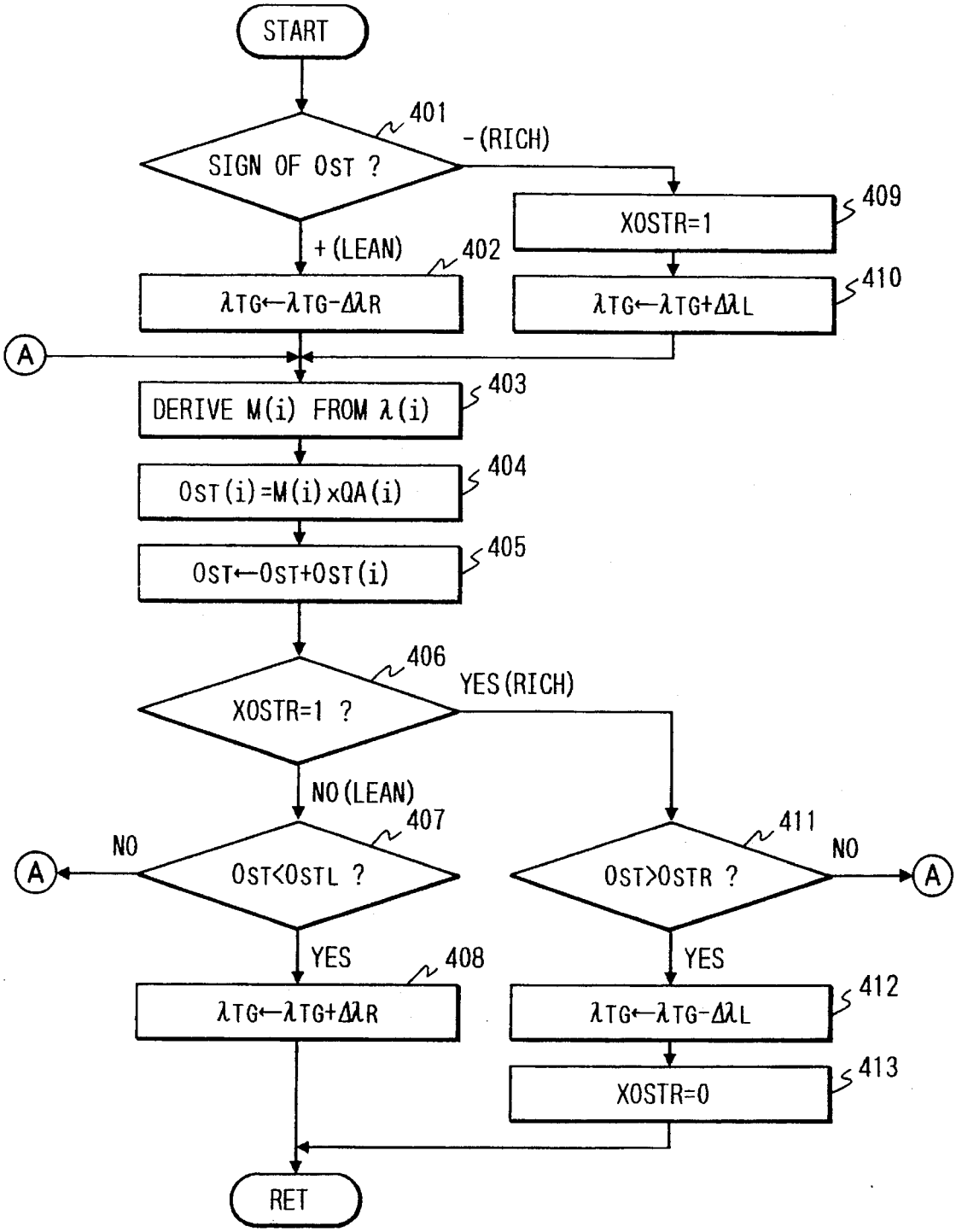
FIG. 10 is a flowchart of a purge control routine according to the first preferred embodiment.

FIG. 10 shows a flowchart of a routine of the purge control, which is a subroutine corresponding to the step 212 in FIG. 4.

At a first step 401, the CPU 32 determines whether a sign of the total adsorption amount OST derived at the step 207 in FIG. 4 is positive or negative. Specifically, since the adsorption amount of the harmful components in the three-way catalytic converter 13 is increased due to the deviation of the air-fuel ratio $\lambda$ when the purge control is executed, the step 401 determines whether the adsorbed harmful components are caused by the deviation of the air-fuel ratio $\lambda$ on the lean side or the rich side.

Assuming that the air-fuel ratio $\lambda$ is deviated to the lean side as represented by a solid line in FIG. 6, the step 401 determines that the sign is positive (lean) so that a step 402 decreases the target air-fuel ratio $\lambda TG$ by a rich purge correction mount $\Delta\lambda R$ ($\lambda TG \leftarrow \lambda TG - \Delta\lambda R$). The rich purge correction mount $\Delta\lambda R$ is set to a value larger than the rich and lean skip amount $\lambda SKR$, $\lambda SKL$ to be used in the inversion skip control. As a result, the target air-fuel ratio $\lambda TG$ set in the inversion skip control routine is largely corrected toward the rich side by the rich purge correction mount $\Delta\lambda R$ so that the actual air-fuel ratio $\lambda(i)$ monitored by the A/F sensor 26 will also be corrected toward the rich side.

Subsequently, a step 403 derives a current value M(i) of the material concentration M from the air-fuel ratio λ(i) detected by the A/F sensor 26 using the map of FIG. 5, as executed at the step 205 in FIG. 4. Then, a step 404 derives an adsorption mount OST(i) from the material concentration M(i) and the intake air quantity QA(i) based on the following equation:

$$OST(i)=M(i)\times QA(i)$$

Further, at a step 405, the total adsorption amount OST derived at the step 207 in FIG. 4 is updated by the adsorption amount OST(i) derived at the step 404 (OST←OST+OST(i)). As shown in FIG. 5, since the air-fuel ratio λ(i) is corrected toward the rich side across the stoichiometric air-fuel ratio, a polarity of the material concentration M(i) becomes negative so that a polarity of the adsorption amount OST(i) also becomes negative. As a result, the total adsorption mount OST is decreased by the adsorption amount OST(i) at the step 405. This means that, the correction of the air-fuel ratio λ to the rich side across the stoichiometric air-fuel ratio decreases the adsorption mount of $O_2$ and NOx in the three-way catalytic converter 13. This change of the adsorption mount in the three-way catalytic converter 13 is estimated based on the variation in the air-fuel ratio λ monitored by the A/F sensor 26, in this purge control routine. Hereinbelow, "purge" is defined as a phenomenon wherein the harmful components in the three-way catalytic converter 13 are neutralized by the air-fuel ratio control so that the adsorption mount is reduced.

Thereafter, the routine proceeds to a step 406 which determines whether or not an adsorption amount rich flag XOSTR is set. When the flag XOSTR is set, this means that the air-fuel ratio λ before the target air-fuel ratio λTG is corrected at the step 402 is rich. Since the flag XOSTR is not set this time, the routine proceeds to a step 407 which determines whether the total adsorption amount OST derived at the step 405 is decreased less than a lean purge completion value OSTL. If answer at the step 407 is negative, the execution of the steps 403 to 407 is repeated so as to gradually decrease the total adsorption mount OST. When the total adsorption mount OST becomes less than the lean purge completion value OSTL, the routine proceeds to a step 408 where the target air-fuel ratio λTG is returned to the value before corrected at the step 402 (λTG←λTG+ΔλR), and is terminated. As a result, the adsorption amount of $O_2$ (NOx) in the three-way catalytic converter 13 is decreased to almost 0 (zero) when this purge control routine is finished.

In consideration of the air-flow delay in the engine 1, a timing of finishing the purge control is advanced by three engine rotations relative to a timing when $O_2$ (NOx) adsorbed in the three-way catalytic converter 13 is completely purged. Specifically, the lean purge completion value OSTL is derived by the following equation:

$$OSTL=-M(i)\times QA(i)\times 3$$

wherein, the material concentration M(i) and the intake air quantity QA are the newest data, respectively, during the purge control routine.

Further, since the material concentration M(i) is a negative value in the purge control as described above and since the lean purge completion value OSTL is a positive value as understood from FIG. 5, a sign of the material concentration M(i) is inverted in the above equation.

On the other hand, when the air-fuel ratio λ is deviated to the rich side with respect to the stoichiometric air-fuel ratio λ=1 as indicated by a two-dot chain line in FIG. 6, the purge control is executed in the following manner:

The step 401 determines that the sign of the total adsorption mount OST is negative (rich). Subsequently, the flag XOSTR is set at a step 409. This means that the air-fuel ratio λ before the target air-fuel ratio λTG is corrected at a subsequent step 410 is rich. Thereafter, the step 410 largely corrects the target air-fuel ratio λTG toward the lean side across the stoichiometric air-fuel ratio by a lean purge correction amount ΔλL (λTG←λTG+ΔλL). Subsequently, the step 403 derives a current value M(i) of the material concentration M, the step 404 derives the adsorption amount OST(i), and the step 405 derives the total adsorption amount OST, as described above. In this purge control routine, since the air-fuel ratio λ(i) will be corrected to the lean side across the stoichiometric air-fuel ratio, signs of the material concentration M(i) and the adsorption amount OST(i) respectively become positive. Accordingly, the total adsorption amount OST is increased by the adsorption amount OST(i) derived at the step 404. Thereafter, since the flag XOSTR is set at the step 409, the step 406 produces a positive answer this time so that the routine proceeds to a step 411. The step 411 determines whether the total adsorption amount OST is greater than a rich purge completion value OSTR. The rich purge completion value OSTR is derived in the same manner as that for deriving the lean purge completion value OSTL. Specifically, since the material concentration M(i) is a positive value in this purge control and since the rich purge completion value OSTR is a negative value as understood from FIG. 5, a sign of the material concentration M(i) should also be inverted for deriving the rich purge completion value OSTR.

If answer at the step 411 is negative, the execution of the steps 403 to 406 and 411 is repeated to increase the total adsorption amount OST until the step 411 produces a positive answer. When the step 411 produces the positive answer, i.e. the total adsorption amount OST becomes greater than the rich purge completion value OSTR, the routine proceeds to a step 412 where the target air-fuel ratio λTG is returned to the value (λTG←λTG−ΔλL) before the target air-fuel ratio λTG is corrected at the step 410. The routine further proceeds to a step 413 where the flag XOSTR is cleared, and is terminated.

As described above, when the air-fuel ratio λ(i) is deviated outside the rage between the rich side limit value λRL and the lean side limit value λLL, the steps 205 to 210 in FIG. 4 are executed repeatedly until the sampling time Tα is reached, so as to derive the total amount of the harmful components to be adsorbed in the three way catalytic converter 13. Thereafter, at the step 402 or 410 in the purge control routine of FIG. 10, the target air-fuel ratio λTG is largely corrected in a direction opposite to the deviation of the air-fuel ratio λ so as to purge the adsorbed harmful components. Variation in $O_2$ adsorption amount in the three way catalytic converter 13 is estimated based on variation in air-fuel ratio α through the steps 403 to 407 or 403 to 411. When the adsorption amount is restored to 0 (zero), the step 408 or 412 returns the target air-fuel ratio λTG to a value before the correction at the step 402 or 410. This means that, when the air-fuel ratio λ is deviated to the rich or lean side, the air-fuel ratio λ is corrected to a side opposite to the deviation side so as to offset or counterbalance the deviation of the air-fuel ratio λ.

Accordingly, the air-fuel ratio control system according to this preferred embodiment not only converges the deviated air-fuel ratio λ toward the stoichiometric air-fuel ratio λ=1 as in the foregoing conventional systems, but also restores the adsorption capability of the three-way catalytic converter 13 by purging the adsorbed harmful components. As a result, when the air-fuel ratio λ is again deviated, the fully restored adsorption capability of the three-way catalytic converter 13 securely adsorbs the harmful components. Further, as is known, the $O_2$ sensor 27 provided downstream of the three-way catalytic converter 13 reveals its high sensitiveness only at a narrow range near the stoichiometric air-fuel ratio λ=1. In this regard, since the air-fuel ratio λ downstream of the three-way catalytic converter 13 is constantly held near the stoichiometric air-fuel ratio λ=1 by purging the harmful components in the exhaust gas in this preferred embodiment, the air-fuel ratio λ can be detected utilizing the high sensitiveness of the $O_2$ sensor 27.

Moreover, since the total adsorption amount OST is derived based on the detection values of the A/F sensor 26 provided upstream of the three-way catalytic converter 13, the highly accurate value can be derived. Specifically, since the three-way catalytic converter 13 has the so-called storage effect, if the air-fuel ratio λ is detected downstream of the three-way catalytic converter 13, a certain time is required for variation in air-fuel ratio λ on the upstream side to be reflected on the air-fuel ratio λ on the downstream side so that only old data is obtained. On the other hand, by detecting the air-fuel ratio λ on the upstream side, the purge control is executed based on new data. Accordingly, for example, the step 407 or 411 can determine an exact timing of finishing the purge control so that the purge control is prevented from being excess or short.

Now, the adsorption amount learning control for updating the minimum adsorption mount OSTmin and the maximum adsorption mount OSTmax of the three-way catalytic converter 13 which are used at the step 208 in FIG. 4 and the steps 305 and 309 in FIG. 7, will be described hereinbelow.

Figure 11:
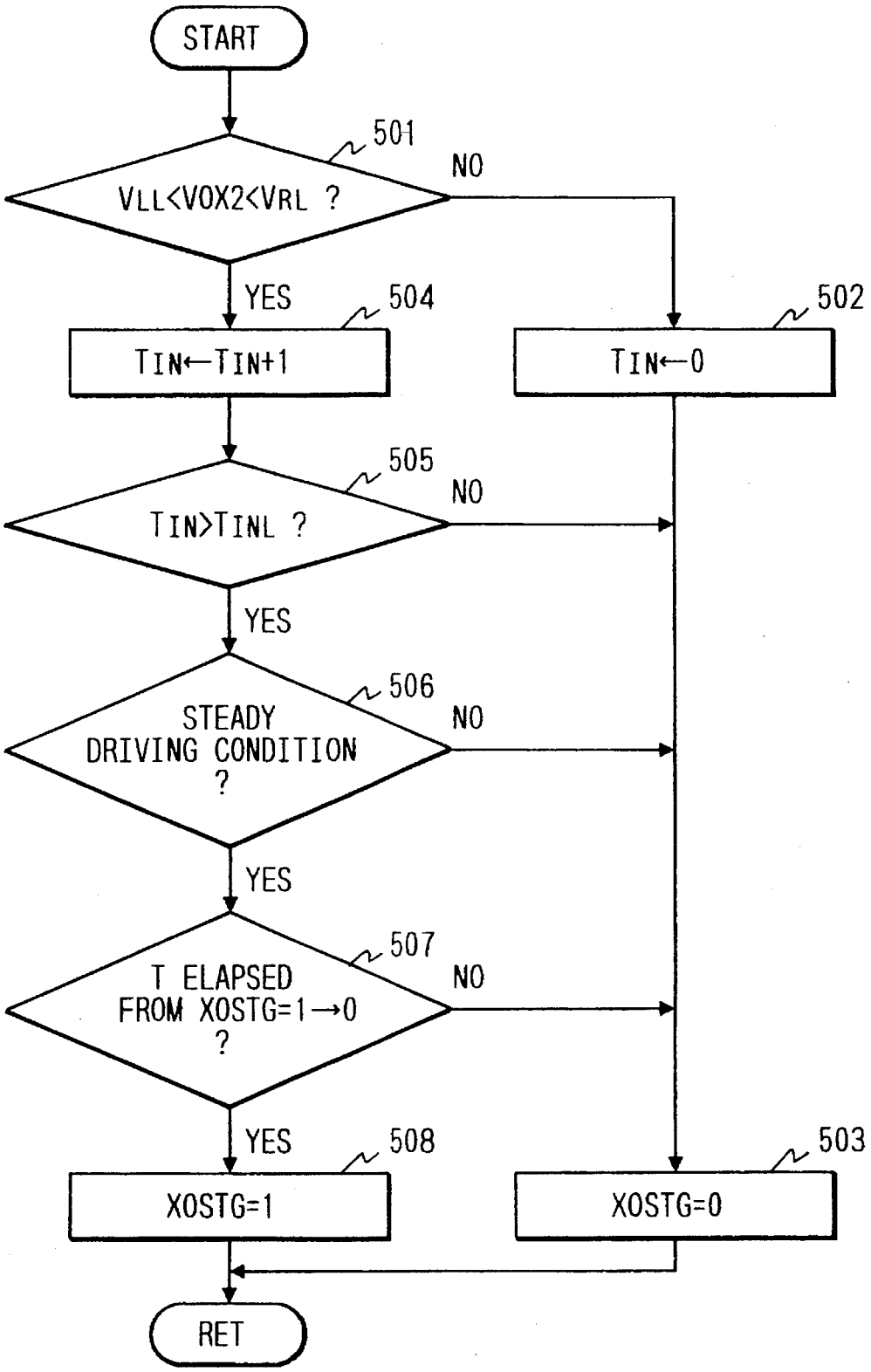
FIG. 11 is a flowchart of a learning start determining routine according to the first preferred embodiment.
Figure 12:
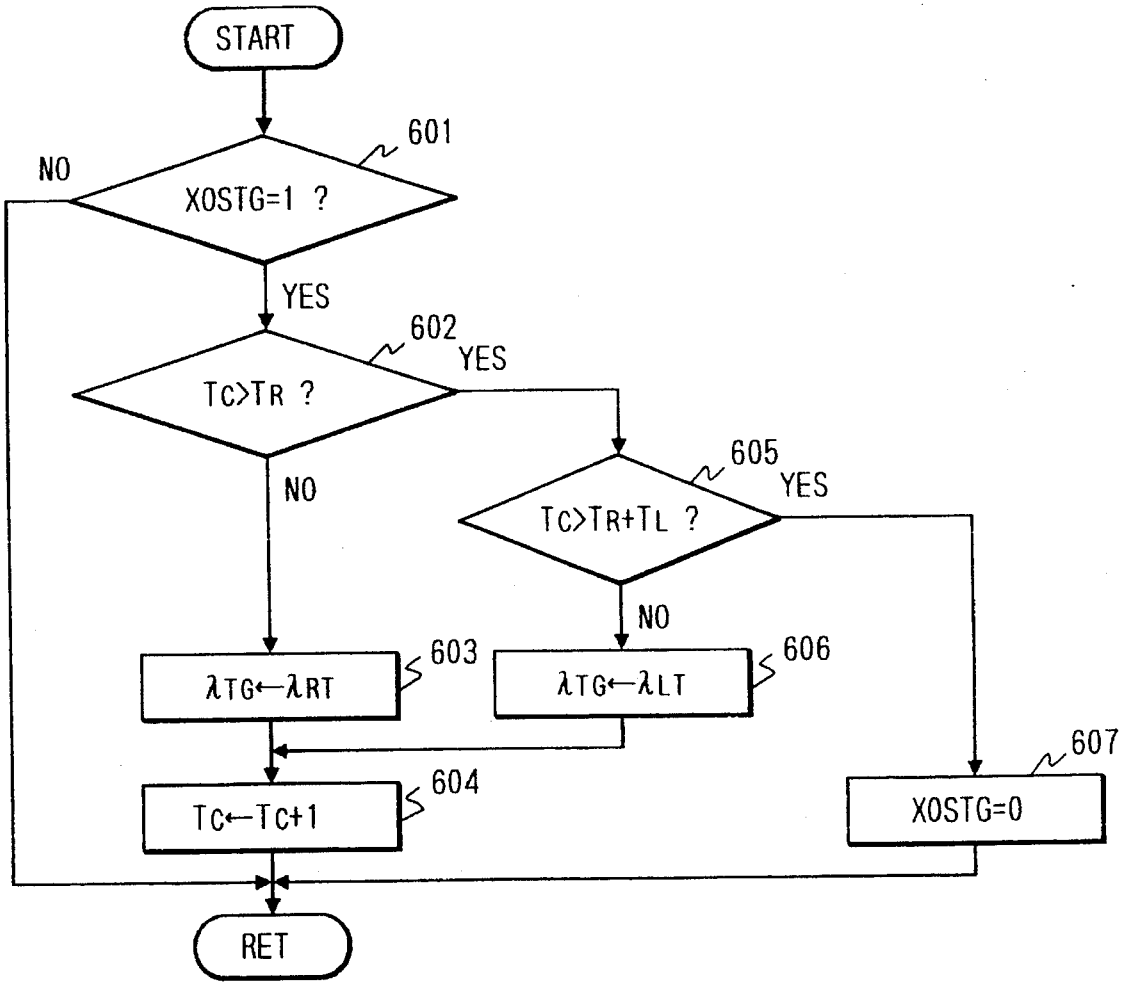
FIG. 12 is a flowchart of an air-fuel ratio deviation control routine according to the first preferred embodiment.
Figure 13:
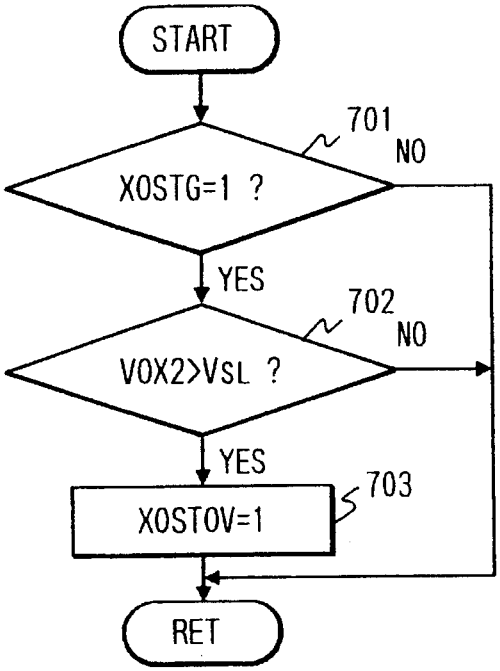
FIG. 13 is a flowchart of a saturation determining routine according to the first preferred embodiment.
Figure 14:
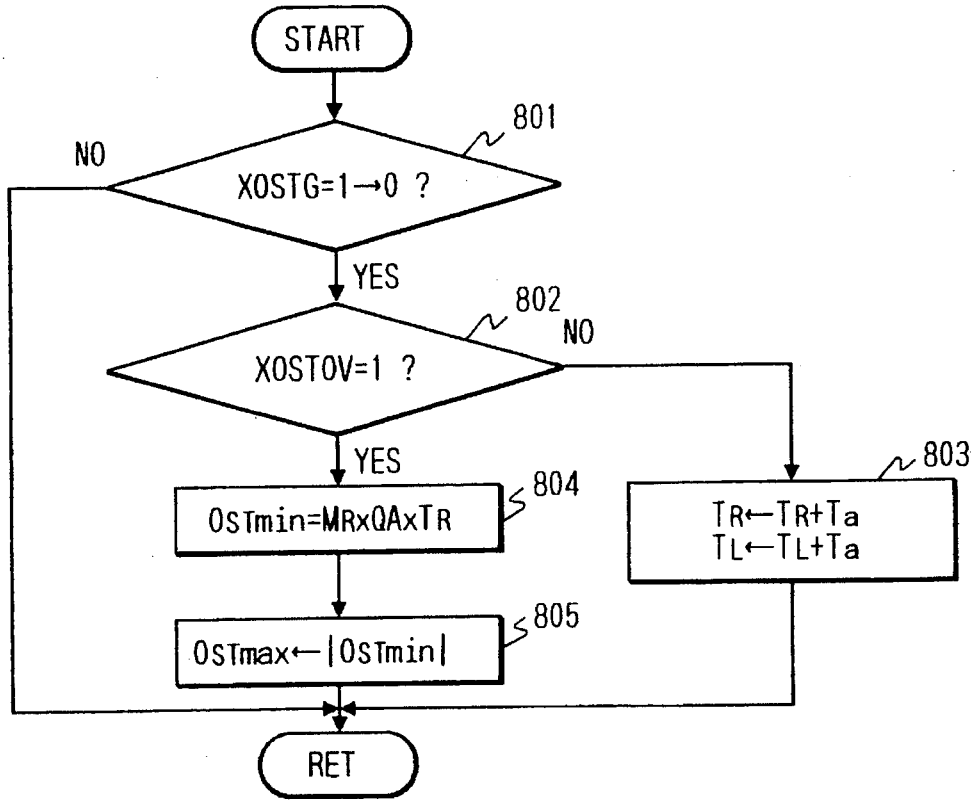
FIG. 14 is a flowchart of an adsorption amount deriving routine according to the first preferred embodiment.

FIG. 11 shows a flowchart of a learning start determining routine, FIG. 12 shows a flowchart of an air-fuel ratio deviation control routine, FIG. 13 shows a flowchart of a saturation determining routine, and FIG. 14 shows a flowchart of a saturated adsorption amount deriving routine.

The CPU 32 receives a detection signal from a vehicular speed sensor (not shown) per given interval, and these routines are executed by the CPU 32 when the vehicle travels every 2,000 km calculated using the detection signal from the vehicular speed sensor.

In FIG. 11, at a first step 501, the CPU 32 determines whether the monitored output voltage VOX2 of the $O_2$ sensor 27 is within a range defined by a preset rich limit value VRL and a preset lean limit value VLL (VRL>λ=1>VLL). If answer at the step 501 is negative, the routine proceeds to a step 502 as determining that the air-fuel ratio λ is so deviated that a condition is not suitable for executing the adsorption amount learning control. At the step 502, a waiting time counter TIN is reset to 0 (zero). Subsequently, the routine proceeds to a step 503 where a learning executing flag XOSTG is cleared.

On the other hand, when the output voltage VOX2 of the $O_2$ sensor 27 is between the rich limit value VRL and the lean limit value VLL as determined at the step 501, a step 504 increases the waiting time counter TIN by a value "1", and a subsequent step 505 determines whether a value of the waiting time counter TIN exceeds a preset waiting time TINL.

When the waiting time TINL has elapsed as determined at the step 505, the routine proceeds to a step 506 Which determines whether or not the engine 1 is under the steady driving condition. Specifically, this determination is made based on, such as, the engine speed Ne monitored by the speed sensor 25 and the intake air pressure PM monitored by the intake air pressure sensor 22. The step 506 produces a positive answer when these monitored values are substantially constant. In response to a positive answer at the step 506, the routine proceeds to a step 507 which determines whether a preset learning interval time T has elapsed from a time point when the learning executing flag XOSTG was cleared (XOSTG=1→0). If the learning interval time T has elapsed as determined at the step 507, the routine proceeds to a step 508 where the learning executing flag XOSTG is set, and this routine is terminated.

On the other hand, if the output voltage VOX2 of the $O_2$ sensor 27 deviates from the range between the rich limit value VRL and the lean limit value VLL before the steps 505 to 507 all produce the positive answers, then the routine executes the steps 502 and 503 to repeat the process from the step 501.

Figure 15:
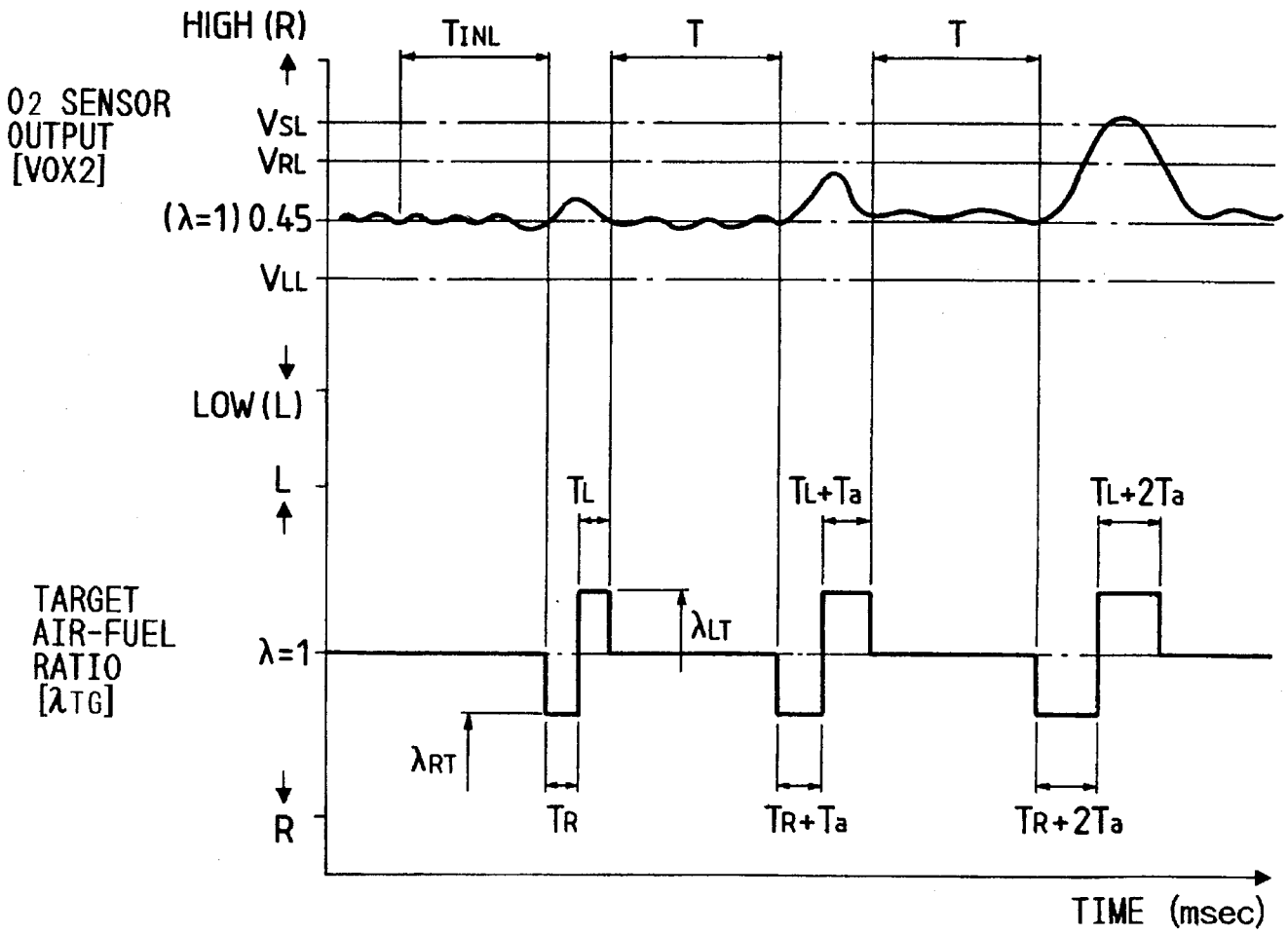
FIG. 15 is a time chart showing a relation between the output of the $O_2$ sensor and the target air-fuel ratio during the air-fuel ratio deviation control of FIG. 12.

Referring now to FIG. 12, when the learning execution flag XOSTG is set at the step 508 in FIG. 11, the routine proceeds from a step 601 to a step 602 which determines whether a value of a correction executing counter Tc exceeds a preset rich correction time TR, i.e. whether the rich correction time TR has elapsed. If the rich correction time TR has not elapsed as determined at the step 602, the routine proceeds to a step 603 where the target air-fuel ratio λTG is set to a preset rich target air-fuel ratio λRT. Thereafter, a step 604 increases the correction executing counter Tc by a value "1", and the routine returns to the step 601. Accordingly, as shown in FIG. 15, the target air-fuel ratio λTG is held at the rich target air-fuel ratio λRT which is on the rich side with respect to the stoichiometric air-fuel ratio λ=1 until the rich correction time TR has elapsed as determined at the step 602. As a result, CO and HC increase in the exhaust gas to be adsorbed to the three-way catalytic converter 13. The $O_2$ sensor 27 produces the output voltage VOX2 on the rich side depending on the adsorption amount in the three-way catalytic converter 13.

When the rich correction time TR has elapsed as determined at the step 602, a step 605 determines whether the value of the correction executing counter Tc exceeds a value which is a sum of the rich correction time TR and a preset lean correction time TL, that is, whether the lean correction time TL has elapsed after the rich correction time TR elapsed. If answer at the step 605 is negative, the target air-fuel ratio λTG is set to a preset lean target air-fuel ratio λLT at a step 606. Subsequently, the routine proceeds to the step 604 where the correction executing counter Tc is increased by "1", and returns to the step 601. Accordingly, as shown in FIG. 15, the target air-fuel ratio λTG is held at the lean target air-fuel ratio λRT which is on the lean side with respect to the stoichiometric air-fuel ratio λ=1 until the lean correction time TL has elapsed as determined at the step 605. As a result, $O_2$ increases in the exhaust gas to purge CO and HC adsorbed to the three-way catalytic converter 13 during the rich correction so that the output voltage VOX2 of the $O_2$ sensor 27 is restored to near the stoichiometric air-fuel ratio λ=1. When the sum of the rich correction time TR and the lean correction time TL has elapsed, the routine proceeds to a step 607 where the learning execution flag XOSTG is cleared, and is terminated.

Referring now to FIG. 13, when the learning executing flag XOSTG is set at the step 508 in FIG. 11, a step 701 produces a positive answer so that the routine proceeds to a step 702. The step 702 determines whether or not the output voltage VOX2 exceeds a preset saturation determining level VSL which is set greater than the rich limit value VRL at the step 501 in FIG. 11, due to the rich correction of the target air-fuel ratio λTG executed at the step 603 in FIG. 12. If the step 702 determines that the output voltage VOX2 does not exceed the saturation determining level VSL, then the routine is terminated. On the other hand, the step 702 produces a positive answer, then the routine proceeds to a step 703 where a saturation determining flag XOSTOV is set, and is terminated. The saturation determining level VSL is preset as representing the output voltage VOX2 which is produced from the $O_2$ sensor 27 when the three-way catalytic converter 13 is saturated, that is, when the adsorption amount of CO and HC exceeds the adsorption limit so that adsorbed CO and HC start to be emitted from the three-way catalytic converter 13.

Referring now to FIG. 14, when the learning execution flag XOSTG is cleared at the step 607 in FIG. 12, the routine proceeds from a step 801 to a step 802 as determining that one cycle of the air-fuel ratio deviation control has been completed. The step 802 determines whether or not the saturation determining flag XOSTOV is set. If the flag XOSTOV is not set, the routine proceeds to a step 803 as determining that the adsorption amount of CO and HC do not exceed the adsorption limit of the three way catalytic converter 13 by the last cycle of the air-fuel ratio deviation control. At the step 803, the rich correction time TR and the lean correction time TL are increased by a preset time Ta, respectively.

Referring back to FIGS. 11 and 12, when the learning interval time T has elapsed from a time point when the learning execution flag XOSTG was cleared at the step 607 in FIG. 12, the routine proceeds from the step 507 to the step 508 in FIG. 11 so that the learning execution flag XOSTG is set. Accordingly, the air-fuel ratio deviation control routine in FIG. 12 is again executed. Since the rich correction time TR has been prolonged by the added time Ta at the step 803 in FIG. 14, the adsorption amount in the three-way catalytic converter 13 is increased in comparison with that in the last cycle of this air-fuel ratio deviation control routine. As appreciated, since the lean correction time TL has been also prolonged by the added time Ta, the air-fuel ratio λ is restored to the stoichiometric air-fuel ratio λ=1 when the air-fuel ratio deviation control is completed. If the step 702 in FIG. 13 still determines that the output voltage VOX2 of the $O_2$ sensor 27 does not exceed the saturation determining level VSL, the rich correction time TR and the lean correction time TL are further prolonged at the step 803 in FIG. 14. On the other hand, the step 702 determines that the output voltage VOX2 exceeds the saturation determining level VSL, the saturation determining flag XOSTOV is set at a step 703.

In response to the setting of the saturation determining flag XOSTOV at the step 703, the routine proceeds from the step 802 to a step 804 in FIG. 14. At the step 804, a current value of the minimum adsorption mount OSTmin of CO and HC in the three-way catalytic converter 13, representative of the lack of $O_2$ required by CO and HC as described before, is derived based on the following equation:

$$OSTmin = MR \times QA \times TR$$

wherein, MR represents the material concentration M. corresponding to the rich target air-fuel ratio λRT and thus derived from the rich target air-fuel ratio λRT using the map of FIG. 5. Accordingly, MR is a negative value, and thus the minimum adsorption amount OSTmin also becomes a negative value.

The routine further proceeds to a step 805 where a current value of the maximum adsorption amount OSTmax is set to the absolute value of the minimum adsorption mount OSTmin derived at the step 804, and is terminated.

The minimum adsorption mount OSTmin and the maximum adsorption mount OSTmax thus derived are used at the step 208 in FIG. 4 and at the steps 305 and 309 in FIG. 7 as described before. Accordingly, the inversion skip control and the purge control are performed based on the minimum and maximum adsorption mounts OSTmin and OSTmax which are updated in consideration of the deterioration of the three-way catalytic converter 13 so that the emission of the harmful components is effectively prevented over a long term.

Now, a second preferred embodiment of the present invention will be described hereinbelow.

The second preferred embodiment differs from the first preferred embodiment in a purge control for setting the target air-fuel ratio λTG.

The following description mainly refers to the difference over the first preferred embodiment.

Figure 16:
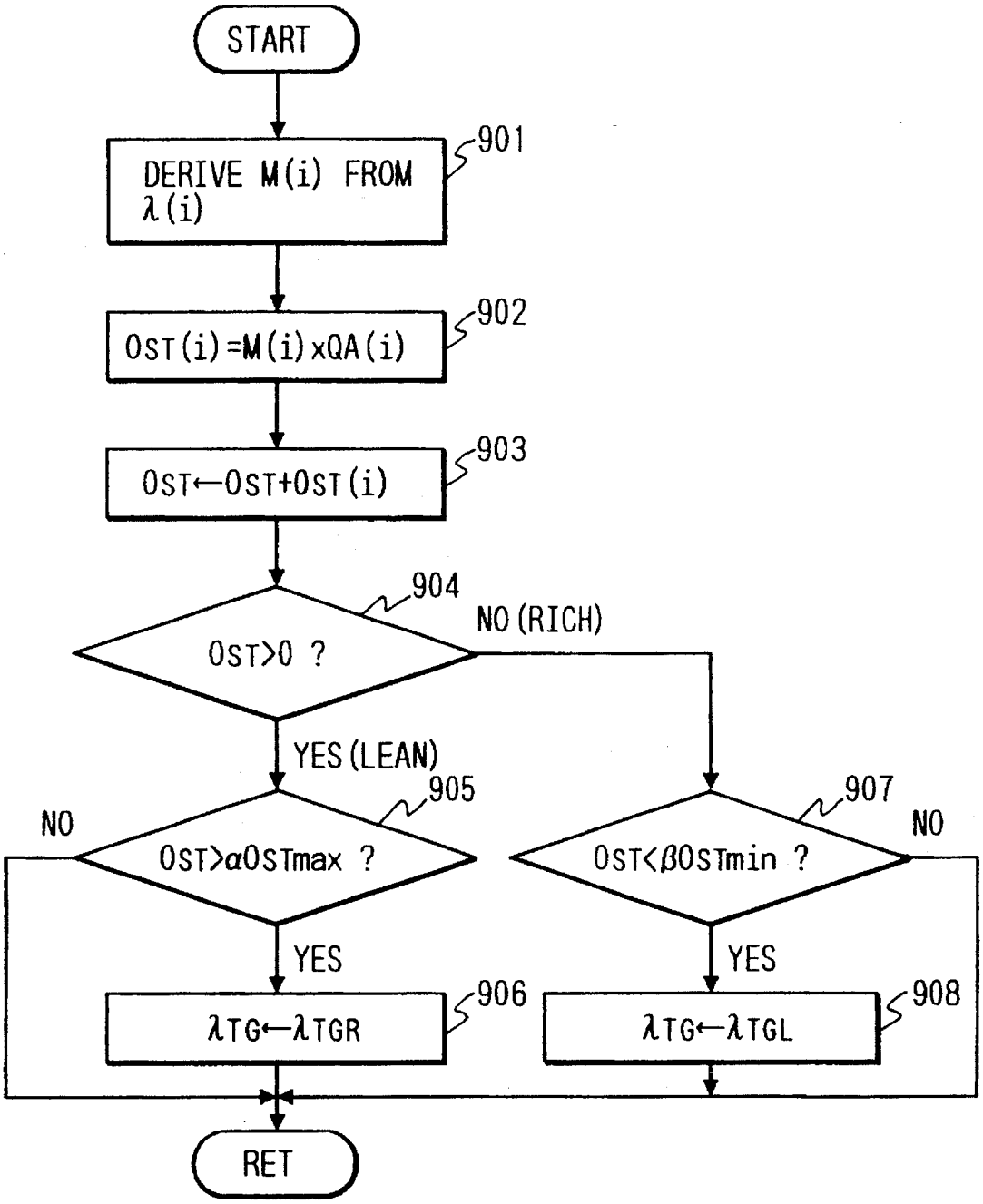
FIG. 16 is a flowchart of a purge control routine according to a second preferred embodiment of the present invention.

FIG. 16 shows a flowchart of a purge control routine according to the second preferred embodiment. In the second preferred embodiment, the purge control is constantly executed, i.e. both at the steady and transitional driving conditions. Accordingly, the routine of FIG. 16 corresponds to the routines as shown in FIGS. 4, 7 and 10 in the first preferred embodiment.

Figure 17:
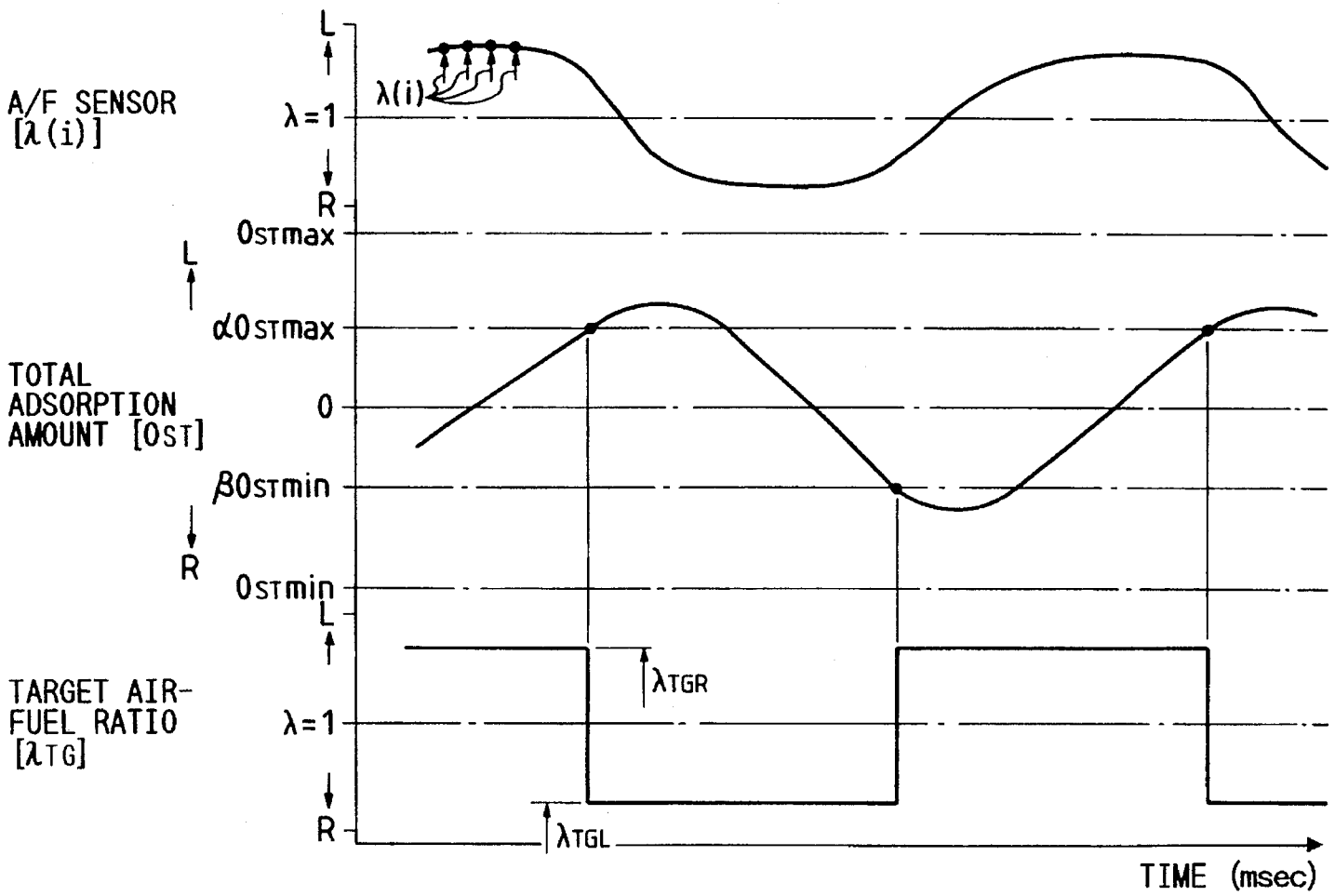
FIG. 17 is a time chart showing a relation among the output of the air-fuel ratio sensor, the adsorption mount and the target air-fuel ratio during the purge control of FIG. 16.

In FIG. 16, a step 901 derives a current value of the material concentration M(i) based on the actual air-fuel ratio λ(i) detected by the A/F sensor 26, using the map of FIG. 5. Subsequently, a step 902 derives the adsorption amount OST(i) based on the material concentration M(i) and the intake air quantity QA(i). Thereafter, a step 903 derives the total adsorption amount OST by OST←OST+OST(i), and then, a step 904 determines whether a sign of the total adsorption amount OST is positive or negative. When the sign is positive, the routine proceeds to a step 905 which determines whether the total adsorption amount OST exceeds a lean side limit value αOSTmax. The value OSTmax is the maximum adsorption amount updated in the adsorption amount learning control in the first preferred embodiment, and the coefficient α is provided in consideration of safety. Accordingly, as seen in FIG. 17, the lean side limit value αOSTmax is set to be sufficiently smaller than the maximum adsorption amount OSTmax. When the total adsorption amount OST does not exceed the lean side limit value αOSTmax at the step 905, the routine returns to the step 901 as determining that the adsorption amount of NOx is so small that the correction of the target air-fuel ratio λTG is not necessary.

On the other hand, if the total adsorption amount OST exceeds the lean side limit value αOSTmax at the step 905, the routine proceeds to a step 906 as determining that it is possible that the adsorption amount of NOx increases to exceed the maximum adsorption amount OSTmax of the three-way catalytic converter 13. Accordingly, at the step 906, the target air-fuel ratio λTG is set to a preset rich purge target value λTGR. The routine then returns to the step 901. As a result, as shown in FIG. 17, the target air-fuel ratio λTG is held at the rich purge target value λTGR which is on the rich side with respect to the stoichiometric air-fuel ratio λ=1. The actual air-fuel ratio λ(i) is corrected to the rich side with a delay, and thereafter, the total adsorption amount OST derived based on the corrected air-fuel ratio λ(i) is corrected to the rich side beyond 0 (zero), i.e. to the negative side.

Subsequently, through the steps 901 to 903, the total adsorption amount OST is updated so that the sign of the total adsorption amount OST becomes negative at the step 904. Now, the routine proceeds to a step 907 which determines whether the total adsorption amount OST is below a rich side limit value βOSTmin. As the lean side limit value αOSTmax, the absolute value of the rich side limit value βOST is set to be sufficiently smaller than that of the minimum adsorption amount OSTmin which is updated in the adsorption amount learning control in the first preferred embodiment. If the total adsorption amount OST is not below the rich side limit value βOSTmin at the step 907, the routine returns to the step 901 as determining that the adsorption amount of the CO and HC is so small that the correction of the target air-fuel ratio λTG is not necessary. On the other hand, when the total adsorption mount OST is below the rich side limit value βOSTmin at the step 907, the routine proceeds to a step 908 as determining that it is possible that the adsorption amount of CO and HC increases to allow the total adsorption mount OST to be below the minimum adsorption mount OSTmin. Accordingly, at the step 908, the target air-fuel ratio λTG is set to a preset lean purge target value λTGL. The routine then returns to the step 901. As a result, as shown in FIG. 17, the target air-fuel ratio λTG is held at the lean purge target value λTGL which is on the lean side with respect to the stoichiometric air-fuel ratio λ=1. The actual air-fuel ratio λ(i) is corrected to the lean side with a delay, and thereafter, the total adsorption amount OST is corrected to the lean side beyond 0 (zero), i.e. to the positive side.

As described above, the target air-fuel ratio λTG is alternately inverted between the rich purge target value λTGR on the rich side and the lean purge target value λTGL on the lean side every time the total adsorption amount OST goes outside the range between the lean side limit value αOSTmax and the rich side limit value βOSTmin. As a result, the total adsorption amount OST is controlled between the maximum and minimum adsorption amounts OSTmax and OSTmin with sufficient margins therefrom, as being fluctuating between the lean and rich sides. Accordingly, the three-way catalytic converter 13 constantly holds the adsorption capability greater than a given level so as to adsorb the harmful components at the time of subsequent deviation of the air-fuel ratio λ so that the purification efficiency is significantly improved.

Now, a third preferred embodiment of the present invention will be described hereinbelow.

The third preferred embodiment differs from the first preferred embodiment in a learning control, wherein, when the air-fuel ratio λ downstream of the three-way catalytic converter 13 detected by the $O_2$ sensor 27 is converging to the stoichiometric air-fuel ratio λ=1, the air-fuel ratio λ on the upstream side detected by the A/F sensor 26 is learned as the stoichiometric air-fuel ratio λ=1.

The following description mainly refers to the difference over the first preferred embodiment.

Figure 18:
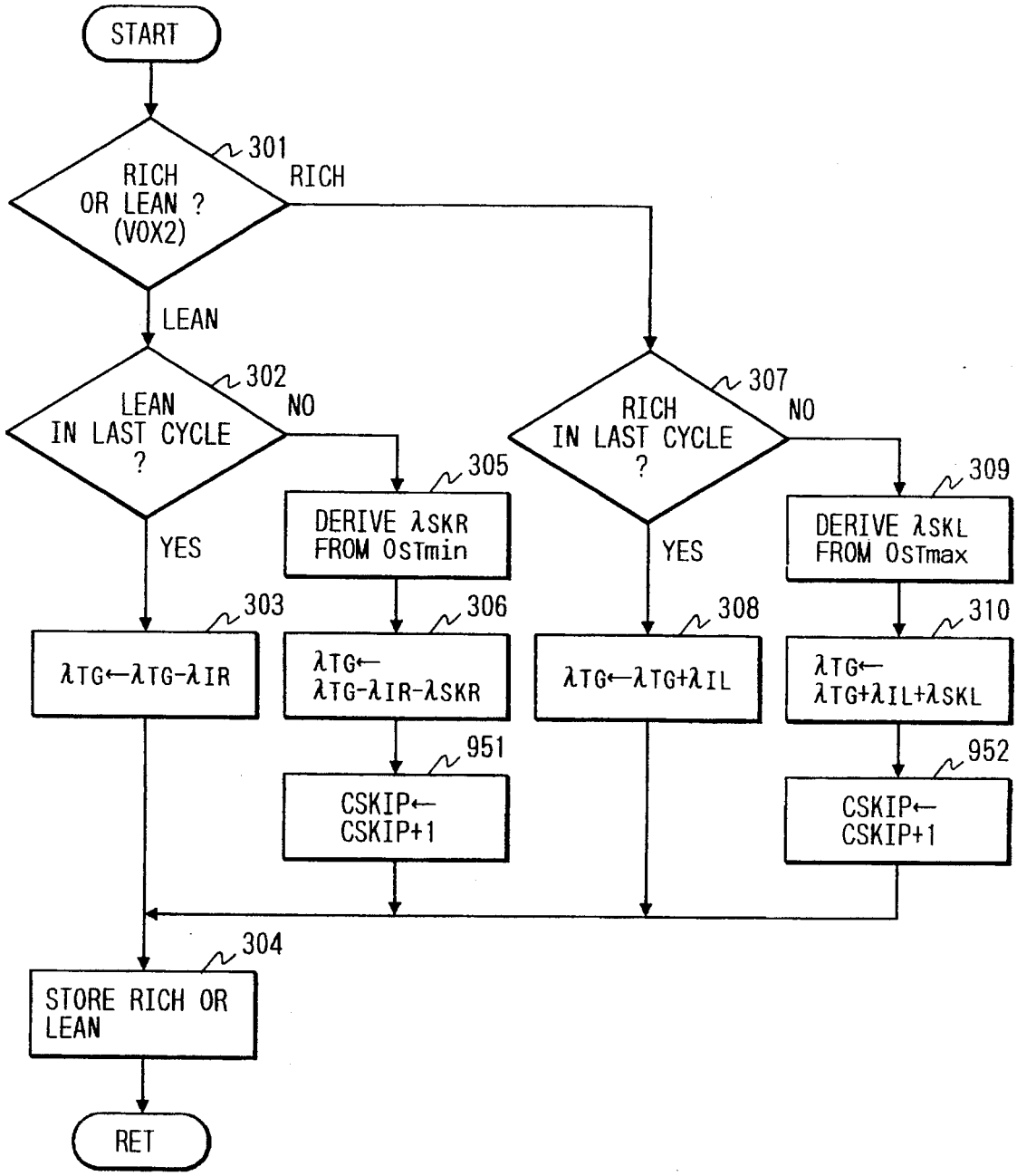
FIG. 18 is a flowchart of an inversion skip control routine according to a third preferred embodiment of the present invention.
Figure 19:
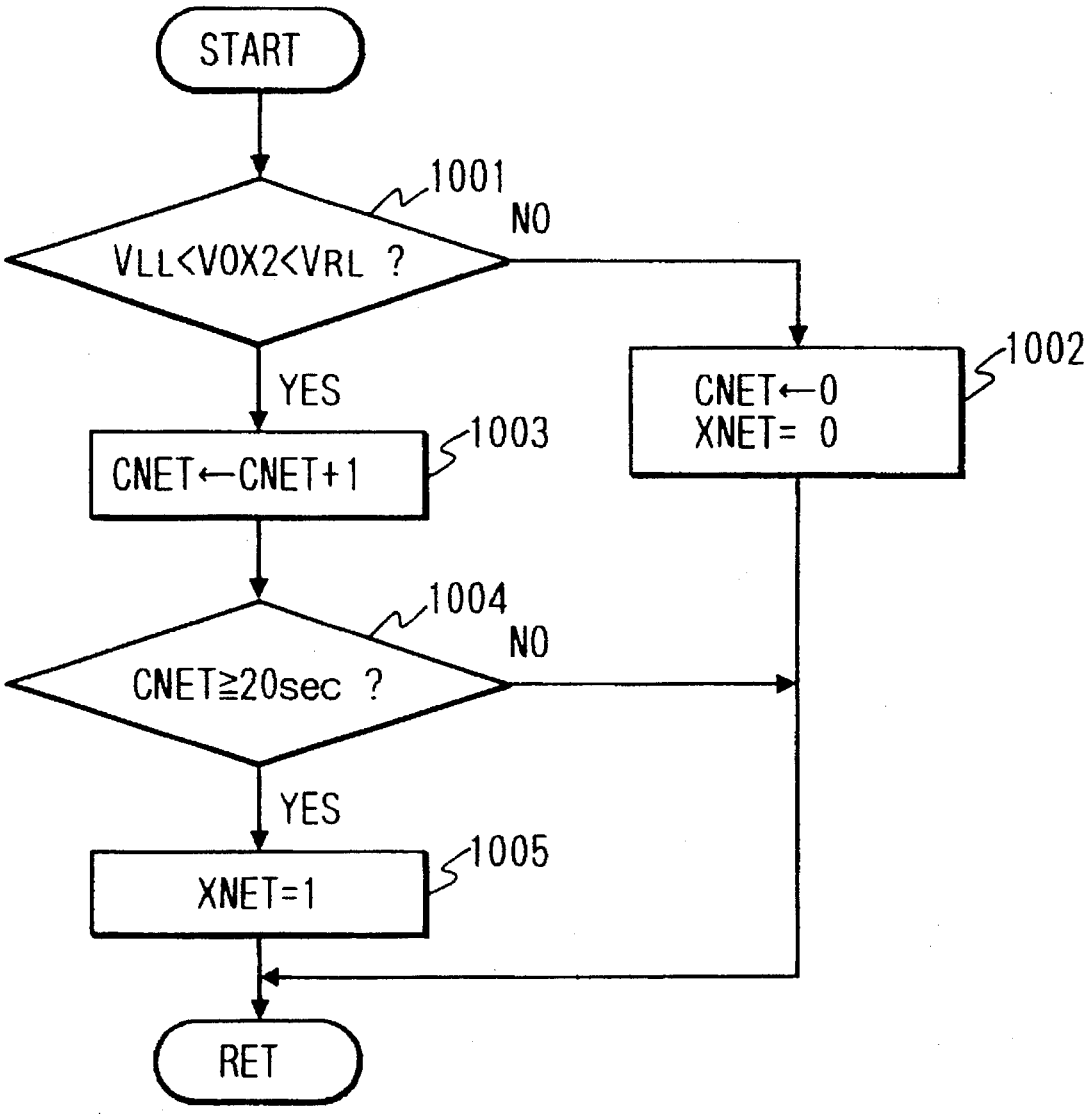
FIG. 19 is a flowchart of a learning start determining routine according to the third preferred embodiment.
Figure 20:
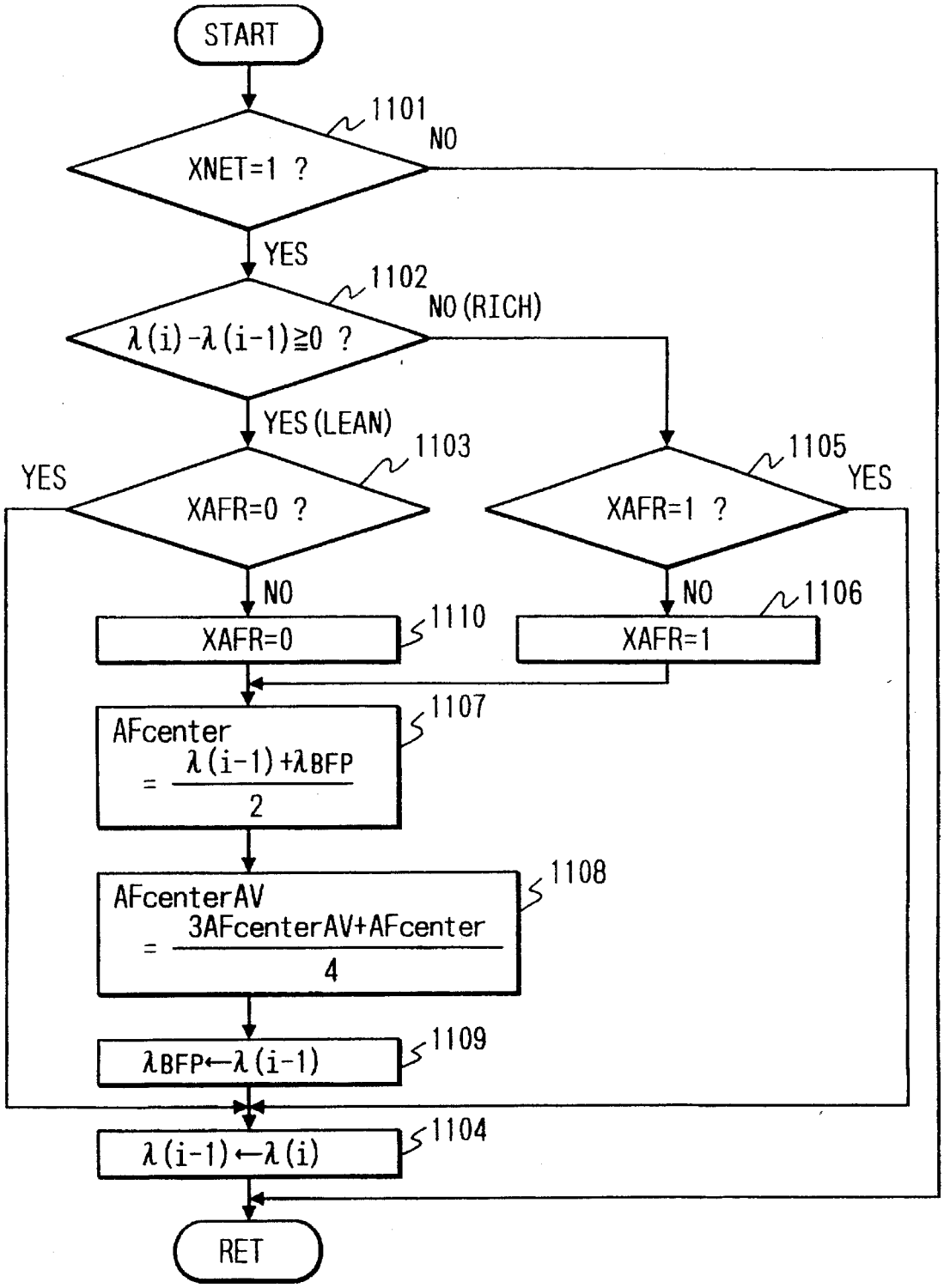
FIG. 20 is a flowchart of an averaging routine for averaging the air-fuel ratio detected by the air-fuel ratio sensor, according to the third preferred embodiment.
Figure 22:
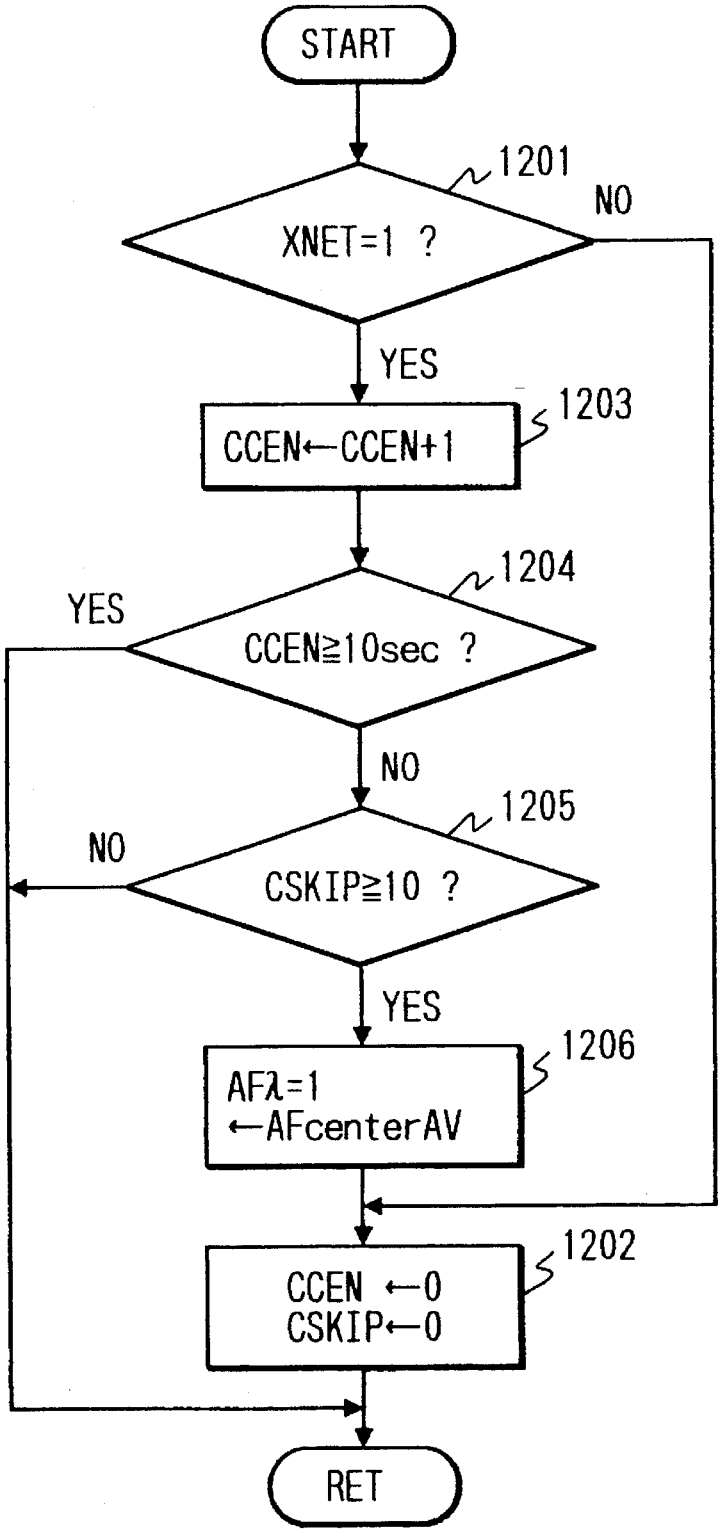
FIG. 22 is a flowchart of a $\lambda=1$ learning routine according to the third preferred embodiment.

FIG. 18 shows a flowchart of an inversion skip control routine according to the third preferred embodiment, FIG. 19 shows a flowchart of a learning start determining routine according to the third preferred embodiment, FIG. 20 shows a flowchart of an averaging routine for the air-fuel ratio detected by the A/F sensor 26 according to the third preferred embodiment, and FIG. 22 shows a flowchart of a λ=1 learning routine according to the third preferred embodiment.

The routine of FIG. 18 is the same as the inversion skip control routine of FIG. 7 in the first preferred embodiment except for steps 951 and 952 which are newly added. When the step 302 determines based on the output voltage VOX2 of the $O_2$ sensor 27 that the air-fuel ratio λ has been inverted from rich to lean with respect to the stoichiometric air-fuel ratio λ=1, the routine proceeds via the step 305 to the step 306 where the target air-fuel ratio λTG is corrected to the rich side in a skipped manner, and then to a step 951 where a skip number counter CSKIP for counting the number of the skip corrections is increased by "1". Similarly, when the air-fuel ratio λ has been inverted from lean to rich at the step 307, the routine proceeds via the 309 to the step 310 where the target air-fuel ratio λTG is corrected to the lean side in a skipped manner, and then to a step 952 where the skip number counter CSKIP is increased by "1". In this manner, when the air-fuel ratio λ downstream of the three-way catalytic converter 13 is inverted between rich and lean so that the skip correction of the target air-fuel ratio λTG is executed, the skip number counter CSKIP is increased one by one.

Referring now to FIG. 19, a step 1001 determines whether the output voltage VOX2 of the $O_2$ sensor 27 is converged within a range defined by a preset rich side limit value VRL and a preset lean side limit value VLL (VRL>λ=1>VLL). If answer at the step 1001 is negative, the routine proceeds to a step 1002 as determining that the air-fuel ratio λ downstream of the three-way catalytic converter 13 is largely fluctuating so that it is not suitable for the execution of the λ=1 learning routine. The step 1002 resets a waiting time counter CNET and clears a learning execution flag XNET, and the routine is terminated.

On the other hand, if answer at the step 1001 is positive, i.e. the output voltage VOX2 is between the rich side limit value VRL and the lean side limit value VLL, the routine proceeds to a step 1003 which increases the waiting time counter by "1", and then to a step 1004 which determines whether the value of the waiting time counter CNET has reached 20 seconds. When 20 seconds have been reached at the step 1004, the routine proceeds to a step 1005 as determining that the air-fuel ratio λ downstream of the three way catalytic converter 13 is sufficiently stable so that the λ=1 learning routine can be executed. The step 1005 sets the learning execution flag XNET, and the routine is terminated.

Referring now to FIG. 20, this averaging routine is executed per 8 msec., i.e. at every timing when the air-fuel ratio λ detected by the A/F sensor 26 is read in by the CPU 32.

The explanation will be made hereinbelow assuming that, in FIG. 21, a point A represents an air-fuel ratio λ(i−1) which was read in in the last cycle of this routine, and a point B, which is located on a position leaner than the point A, represents a current air-fuel ratio λ(i), and that a rich side variation flag XAFR is being cleared. The rich side variation flag XAFR represents, when it is set, that the air-fuel ratio λ was varying toward the rich side in the last cycle of this routine.

In FIG. 20, when answer at a step 1101 is positive, i.e. the learning execution flag XNET is set at the step 1005 in FIG. 19, a step 1102 determines whether λ(i)−λ(i−1) is equal to or greater than 0 (zero). Since λ(i)−λ(i−1) is greater than 0 this time, answer at the step 1102 becomes positive (lean) so that the routine proceeds to a step 1103 which determines whether the rich side variation flag XAFR is cleared. As described above, since the rich side variation flag XAFR is cleared, the routine proceeds to a step 1104 as determining that λ(i−1) is not a peak value since λ(i−1) and λ(i) both have been varied toward the lean side. At the step 1104, λ(i) is stored in the RAM 34 as λ(i−1) for a subsequent cycle of this routine.

Figure 21:
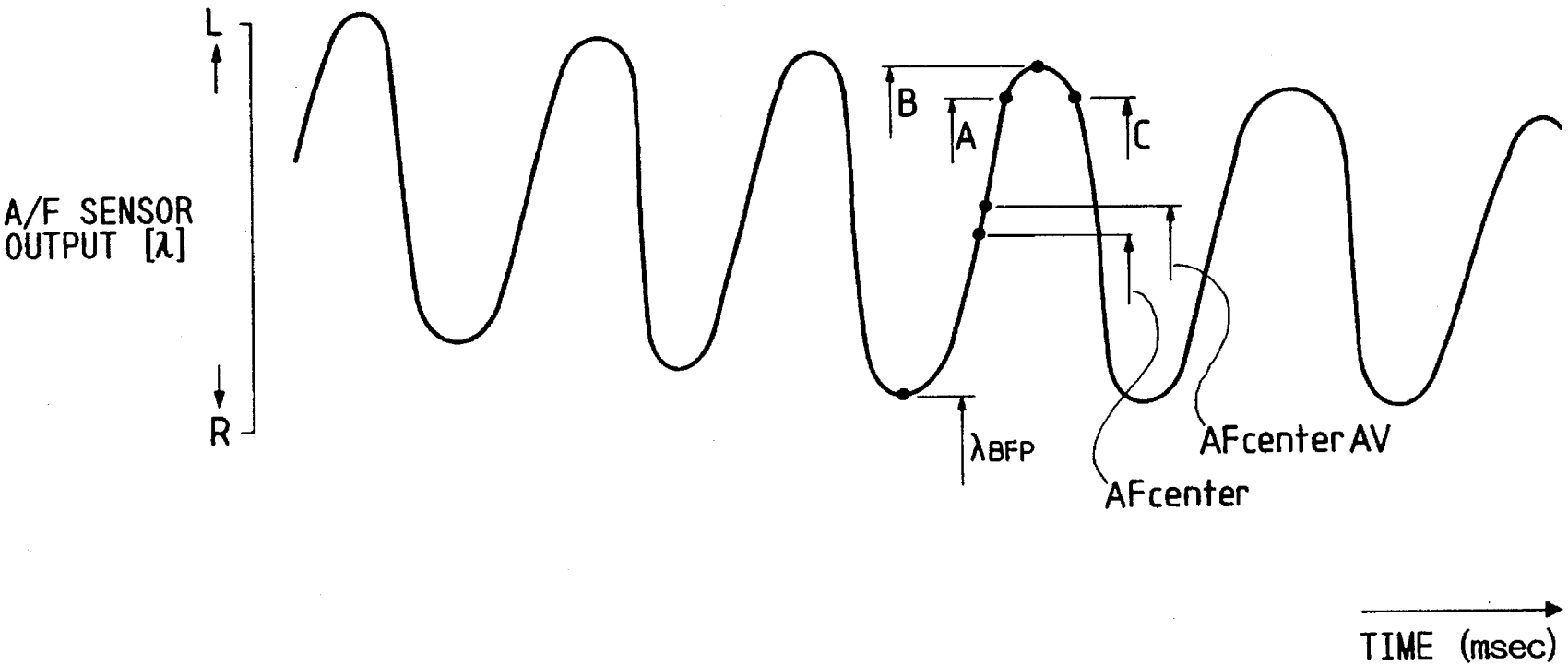
FIG. 21 is a time chart showing a sapling condition of the air-fuel ratio detected by the air-fuel ratio sensor.

Subsequently, when a new air-fuel ratio λ(i) at a point C in FIG. 21 is read in, the step 1102 produces a negative answer (rich) this time so that the routine proceeds to a step 1105 which determines whether the rich-side variation flag XAFR is set. Since the rich-side variation flag XAFR is cleared, the step 1105 produces a negative answer (inversion) so that the routine proceeds to a step 1106 as determining that λ(i−1) (point B) is a peak value since λ(i−1) was varied toward the lean side (to the point B) while λ(i) was varied toward the rich side (to the point C). At the step 1106, the rich-side variation flag XAFR is set. Subsequently, the routine proceeds to a step 1107 which derives a center air-fuel ratio AFcenter by averaging λ(i−1) (point B) and a newest peak value λBFP stored in the RAM 34. The last peak value λBFP represents a peak value when the air-fuel ratio λ was varied toward the rich side last time. Further, a step 1108 attenuates influence of the center air-fuel ratio AFcenter by a last mean air-fuel ratio AFcenterAV to derive a current mean air-fuel ratio AFcenterAV. Thereafter, a step 1109 stores λ(i−1) (point B) in the RAM 34 as a newest peak value kBFP, and this routine is terminated via the foregoing step 1104.

To the contrary, when the inversion has been caused from rich to lean as determined at the step 1103, the routine proceeds to a step 1110 which clears the rich-side variation flag XAFR. Thereafter, the routine proceeds to the step 1107 where the center air-fuel ratio AFcenter is derived, and further to the step 1108 where the mean air-fuel ratio AFcenterAV is derived.

Through the above described averaging routine, the ripple fluctuation of the air-fuel ratio λ detected by the A/F sensor 26 is eliminated so that the λ=1 learning routine, which will be described in detail hereinbelow, can be performed more reliably.

Referring now to FIG. 22, a step 1201 checks whether the learning execution flag XNET is set. If answer at the step 1201 is negative, i.e. the learning execution flag XNET is not set at the step 1005 in FIG. 19, the routine proceeds to a step 1202 which resets a skip time counter CCEN and the foregoing skip number counter CSKIP, and the routine is terminated, i.e. the λ=1 learning routine is not executed.

On the other hand, when the learning execution flag XNET is set as determined at the step 1201, i.e. the air-fuel ratio λ downstream of the three-way catalytic converter 13 is sufficiently stable, the routine proceeds to a step 1203 which increases the skip time counter CCEN by "1". Subsequently, a step 1204 determines whether a value of the skip time counter CCEN has reached 10 seconds. When the value of the skip time counter CCEN has not reached 10 seconds, a step 1205 determines whether the value of the skip number counter CSKIP is equal to or greater than 10.

When the value of the skip time counter CCEN reaches 10 seconds at the step 1204 before the value of the skip number counter CSKIP reaches 10, the routine is terminated. Specifically, when the number of the skip corrections per unit time is small as above, it can be determined that the inversion of the air-fuel ratio λ between rich and lean is not frequent on the downstream side so that the air-fuel ratio λ on the downstream side is not converged to near the stoichiometric air-fuel ratio λ=1.

As is known, the air-fuel ratio λ on the upstream side detected by the A/F sensor 26 includes an error caused by various factors, such as, an individual characteristic or a deterioration condition of the sensor, a flow rate of the exhaust gas, or an impinging condition of the exhaust gas upon the sensor. On the other hand, the inventors of the present invention have confirmed that the air-fuel ratio λ on the downstream side detected by the $O_2$ sensor 27 correctly reveals without such an error whether the air-fuel ratio λ is controlled within a window of the stoichiometric air-fuel ratio λ=1. Accordingly, when the air-fuel ratio λ on the downstream side is not converged to near the stoichiometric air-fuel ratio λ=1 as described above, it can be estimated that the air-fuel ratio λ on the upstream side is not converged to near the stoichiometric air-fuel ratio λ=1.

On the other hand, when the value of the skip number counter CSKIP becomes equal to or greater than (10) at the step 1205 before the value of the skip time counter CCEN reaches 10 sec at the step 1204, the routine proceeds to a step 1206. When the number of the skip corrections is large per unit time as above, it can be determined that the air-fuel ratio λ on the downstream side is frequently inverted between rich and lean to be converged to near the stoichiometric air-fuel ratio λ=1. Accordingly, it can be estimated this time that the air-fuel ratio λ on the upstream side is converged to near the stoichiometric air-fuel ratio λ=1. For this reason, the step 1206 learns this air-fuel ratio λ on the upstream side, i.e. the mean air-fuel ratio AFcenterAV derived in the foregoing averaging routine, as representing the λ=1 point (AFλ=1← AFcenterAV).

In this preferred embodiment, the air-fuel ratio λ detected by the A/F sensor 26 is corrected based on the thus leaned AFλ=1, and this corrected air-fuel ratio λ is used, for example, at the step 205 in FIG. 4 and at the step 403 in FIG. 10 for deriving the material concentration M(i). Accordingly, the above-described error of the air-fuel ratio λ on the upstream side is effectively eliminated so that the total adsorption amount OST is derived with high accuracy to enable the execution of the purge control based on this highly reliable total adsorption amount OST. As a result, for example, those situations are effectively prevented, wherein the purge control is performed to correct the target air-fuel ratio λTG to the lean side when the air-fuel ratio is actually deviated to the lean side, or the purge finish timing can not be determined precisely to cause the correction being excessive or short.

Now, a fourth preferred embodiment of the present invention will be described hereinbelow.

The fourth preferred embodiment differs from the first preferred embodiment in a purge prohibiting process which determines before the start of the purge based on the air-fuel ratio λ on the downstream side detected by the $O_2$ sensor 27 whether a direction of the purge to be executed is correct or wrong, and in a purge halting process which determines during the execution of the purge based on the air-fuel ratio λ on the downstream side detected by the $O_2$ sensor 27 whether a direction of the executed purge is correct or wrong.

The following description mainly refers to the difference over the first preferred embodiment.

Figure 23:
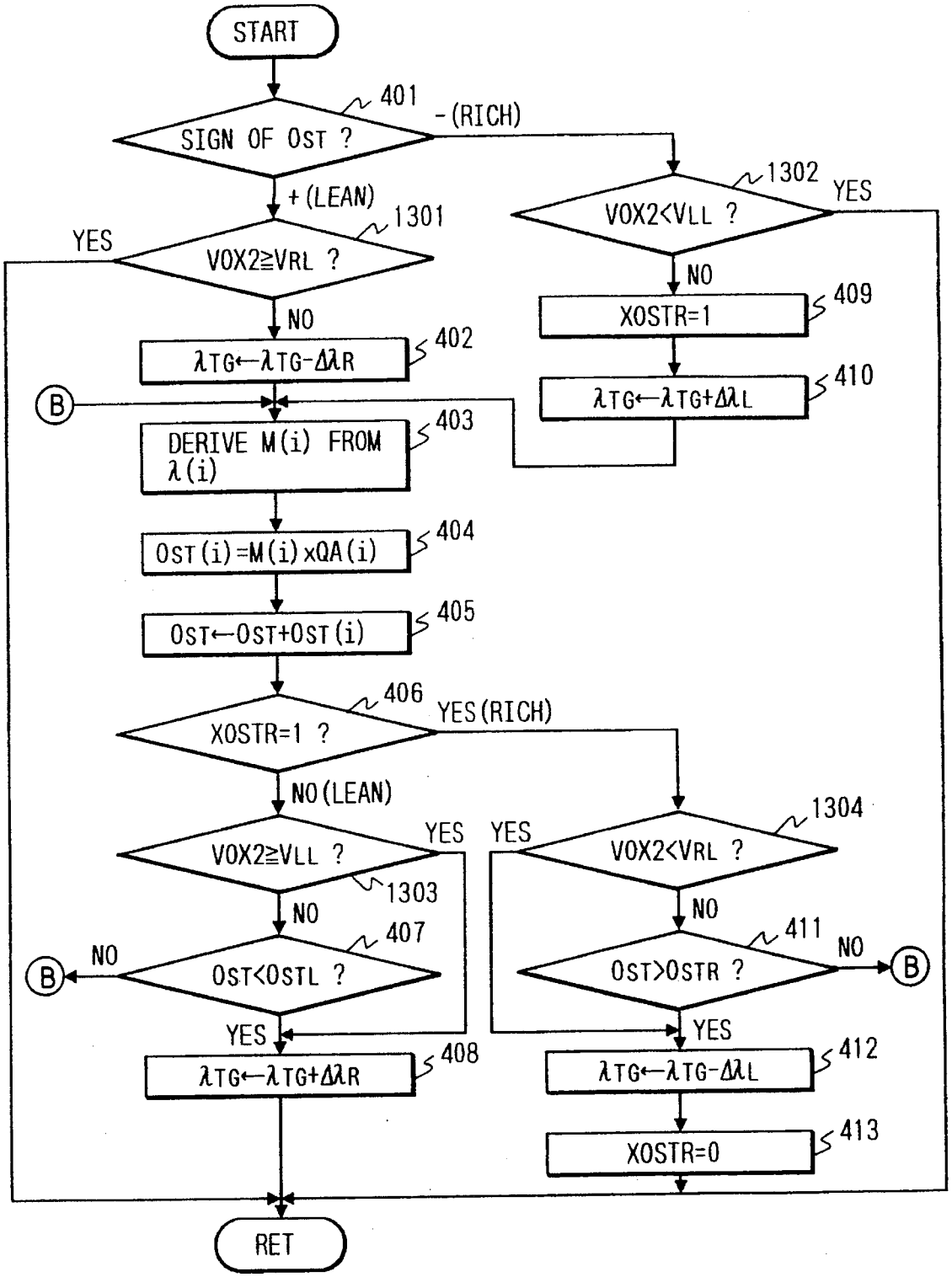
FIG. 23 is a flowchart of a purge control routine according to a fourth preferred embodiment of the present invention.

FIG. 23 shows a flowchart of a purge control routine according to the fourth preferred embodiment. The routine of FIG. 23 is the same as the purge control routine of FIG. 10 in the first preferred embodiment except for steps 1301 to 1304 which are newly added.

As in the first preferred embodiment, at a time point when this routine is executed (a time point indicated by T1 in FIG. 24 or 25), the total adsorption amount OST caused by the deviation of the air-fuel ratio λ is derived at the step 207 in FIG. 4.

Figure 24:
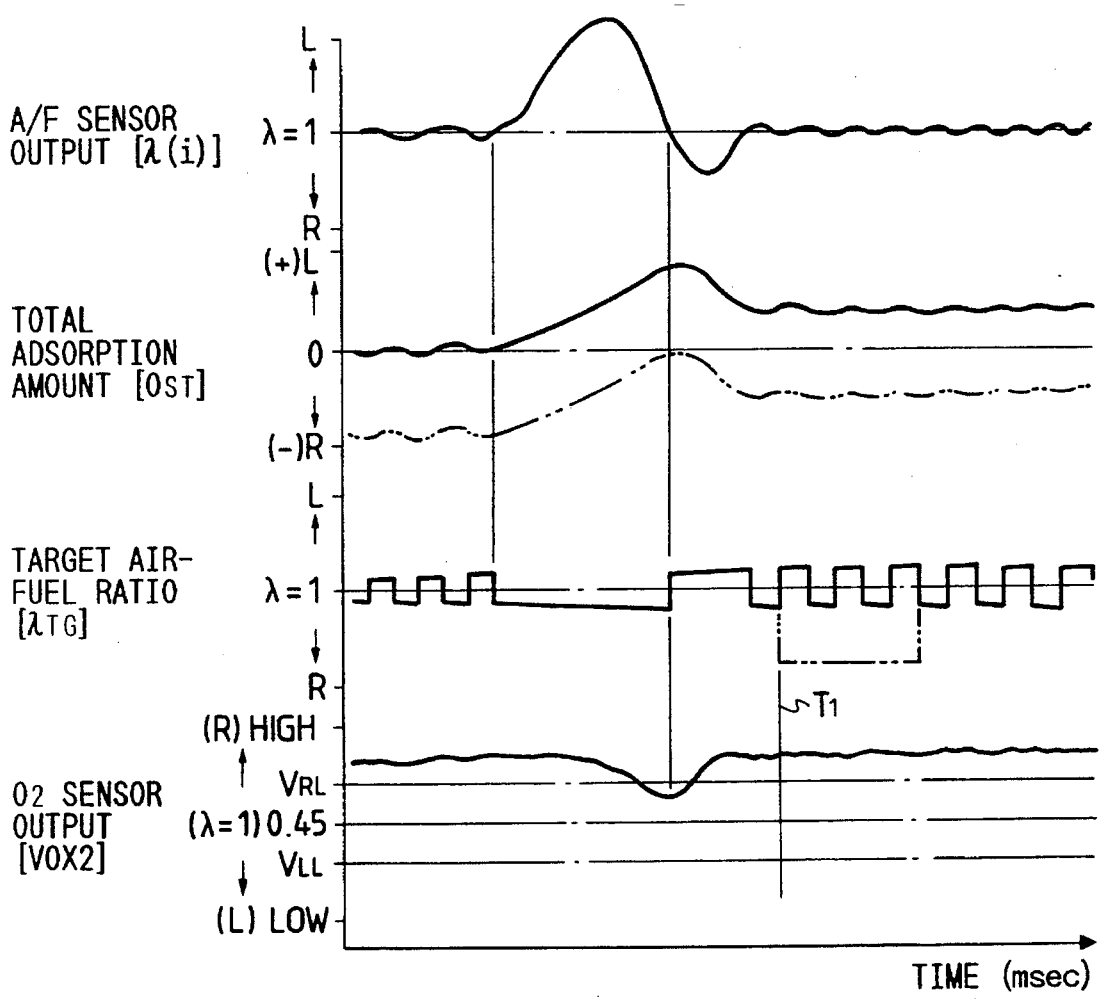
FIG. 24 is a time chart showing a purge prohibiting process in the purge control of FIG. 23.

Now, it is assumed that the air-fuel ratio on the upstream side detected by the A/F sensor 26 is deviated to the lean side as shown in FIG. 24. The step 401 in FIG. 23 determines whether a sign of the total adsorption amount OST is positive or negative. Since the sign is positive this time, the routine proceeds to a step 1301 which determines whether the output voltage VOX2 of the $O_2$ sensor 27 is equal to or greater than a preset rich-side limit value VRL. When the output voltage VOX2 is less than the rich-side limit value VRL at the step 1301, the step 402 and the subsequent steps are executed as in the first preferred embodiment so as to execute the purge by correcting the target air-fuel ratio λTG to the rich-side so that the harmful components adsorbed in the three-way catalytic converter 13 is purged. On the other hand, when the output voltage VOX2 is equal to or greater than the rich-side limit value VRL, the routine is terminated without executing the step 402 and the subsequent steps.

As described in the foregoing third preferred embodiment, since the air-fuel ratio λ on the downstream side detected by the $O_2$ sensor 27 reveals a reliable value, it is possible to presume the adsorbing condition of the harmful components to the three-way catalytic converter 13 based on the air-fuel ratio λ on the downstream side. Accordingly, the process at the step 1301 is for confirming whether a direction of the purge to be executed at the step 402 is correct or not. Specifically, when the output voltage VOX2 is smaller than the rich-side limit value VRL, the possibility is high that the sign of the actual total adsorption mount OST is positive as indicated by a solid line in FIG. 24. This means that the correction of the target air-fuel ratio λTG to the rich side, i.e. the purge to the rich side to be executed at the step 402 can purge the adsorbed harmful components to decrease the total adsorption mount OST. Accordingly, the step 1301 allows the execution of the purge at the step 402 as determining that a direction of the purge is correct. On the other hand, when the output voltage VOX2 is equal to or greater than the rich side limit value VRL, possibility is high that the sign of the actual total adsorption mount OST is negative as indicated by a two-dot chain line in FIG. 24 so that the purge to the rich side to be executed at the step 402 increases the absolute value of the total adsorption amount OST. Accordingly, the step 1301 prohibits the execution of the purge at the step 402 as determining that a direction of the purge is wrong.

On the other hand, when the air-fuel ratio λ on the upstream side is deviated to the rich side so that a negative sign of the total adsorption amount OST is determined at the step 401, the routine proceeds to a step 1302 which determines whether the output voltage VOX2 is less than a preset lean side limit value VLL. When the output voltage VOX2 is equal to or greater than the lean-side limit value VLL at the step 1302, the possibility is high that the sign of the actual total adsorption amount OST is negative so that the correction of the target air-fuel ratio λTG to the lean side, i.e. the purge to the lean side to be executed at the step 410 can decrease the absolute value of the total adsorption amount OST. Accordingly, the step 1302 allows the execution of the purge at the step 410 as determining that a direction of the purge is correct. To the contrary, when the output voltage VOX2 is smaller than the lean-side limit value VLL at the step 1302, the possibility is high that the sign of the actual total adsorption amount OST is positive so that the purge to the lean side to be executed at the step 410 increases the total adsorption amount OST. Accordingly, the step 1302 prohibits the execution of the purge at the step 410 as determining that a direction of the purge is wrong.

As a result, even when the step 401 misjudges the sign of the total adsorption amount OST due to a detection error of the A/F sensor 26, the step 1301 or 1302 prohibits the purge in the same direction as the sign of the actual total adsorption amount OST so that incrementing of the absolute value of the total adsorption amount OST is effectively prevented.

Figure 25:
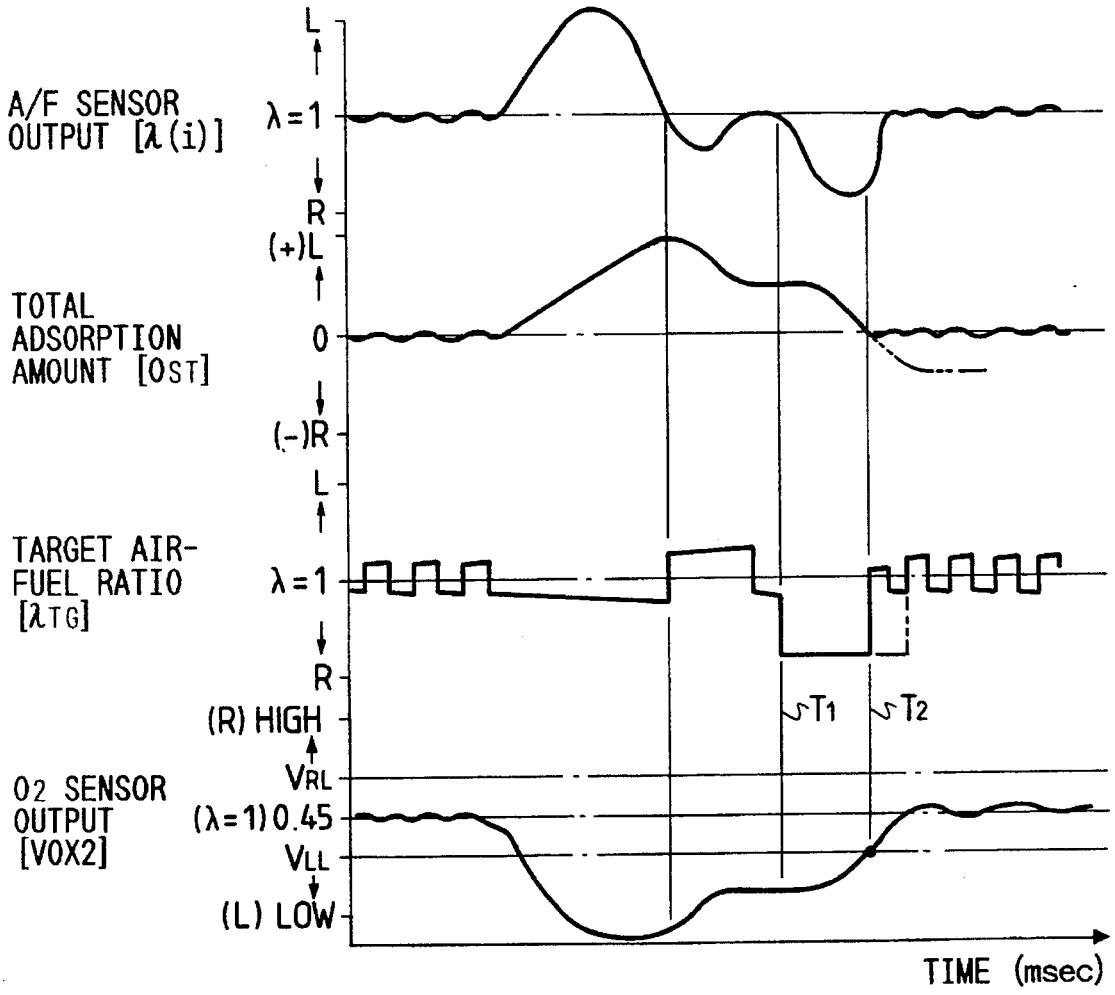
FIG. 25 is a time chart showing a purge halting process in the purge control of FIG. 23.

When the purge to the rich side is started at the step 402 as indicated by a solid line in FIG. 25, the total adsorption amount OST is derived through the steps 403 to 405. Thereafter, the routine proceeds via the step 406 to a step 1303 which determines whether the output voltage VOX2 of the $O_2$ sensor 27 is equal to or greater than the lean-side limit value VLL. If answer at the step 1303 is negative, i.e. the output voltage VOX2 is smaller than the lean-side limit value VLL, the step 407 determines, as in the first preferred embodiment, whether the total adsorption amount OST becomes smaller than the lean purge completion value OSTL. When the total adsorption amount OST is equal to or greater than the lean purge completion value OSTL, the routine returns to the step 403. On the other hand, when the total adsorption mount OST is less than the lean purge completion value OSTL, the step 408 corrects the target air-fuel ratio λTG to the lean side, i.e. the step 408 returns the target air-fuel ratio λTG to the value before the correction at the step 402, and the purge to the rich side is terminated.

On the other hand, when the output voltage VOX2 becomes equal to or greater than the lean-side limit value VLL at the step 1303 before the total adsorption amount OST becomes less than the lean purge completion value OSTL at the step 407, the purge to the rich side is immediately stopped or halted at the step 408.

The process at the step 1303 is for monitoring a delay in purge finishing determination at the step 407. Specifically, when the output voltage VOX2 is smaller than the lean-side limit value VLL at the step 1303, the step 1303 allows the step 407 to determine whether to continue or finish the purge, as determining that the actual total adsorption mount OST is not yet decreased to near 0 (zero) so that it is better to leave the decision to the step 407. To the contrary, when the output voltage VOX2 becomes equal to or greater than the lean side limit value VLL (at a time point indicated by T2 in FIG. 25), the actual total adsorption mount OST is already decreased to near 0 (zero) as indicated by a solid line in FIG. 25. Accordingly, the step 1303 determines that the purge finishing determination at the step 407 is delayed. For this reason, the step 1303 immediately halts the purge at the step 408 since the further purge will be performed in a wrong direction to increase the absolute value of the total adsorption mount OST.

On the other hand, when the purge to the lean side is started at the step 410, the routine proceeds via the steps 403 to 406 to a step 1304 which determines whether the output voltage VOX2 is smaller than the rich side limit value VRL. When the output voltage VOX2 is equal to or greater than the rich side limit value VRL at the step 1304, the step 411 determines, as in the first preferred embodiment, whether the total adsorption mount OST becomes greater than the rich purge completion value OSTR, that is, whether the absolute value of the total adsorption amount OST becomes smaller than the absolute value of the rich purge completion value OSTR. When the total adsorption mount OST is greater than the rich purge completion value OSTR at the step 411, the step 412 corrects the target air-fuel ratio λTG to the rich side, i.e. the step 412 returns the target air-fuel ratio λTG to the value before the correction at the step 410 so that the purge is finished.

On the other hand, when the output voltage VOX2 becomes smaller than the rich side limit value VRL at the step 1304 before the total adsorption amount OST becomes larger than the rich purge completion value OSTR at the step 411, the step 1304 immediately halts the purge at the step 412 as determining that the absolute value of the actual total adsorption amount OST is already decreased to near 0 (zero) so that a delay is caused in purge finishing determination at the step 411, and thus, further purge will be executed in a wrong direction.

As a result, even when the delay in purge finishing determination is caused at the step 407 or 411 due to the detection error of the A/F sensor 26, the purge is halted when the actual total adsorption amount OST approaches close to 0 (zero), so that incrementing of the absolute value of the total adsorption amount OST is effectively prevented, which is otherwise caused due to the further purge in a wrong direction.

As described above, in the fourth preferred embodiment, by comparing the output voltage VOX2 of the $O_2$ sensor 27 with the rich- and lean-side limit values VRL, VLL, it is determined before the start of the purge whether a direction of the purge to be executed is correct. If it is wrong, then the execution of the purge is prohibited. Similarly, it is determined during the execution of the purge whether a direction of the executed purge is correct. If it is wrong, then the execution of the purge is stopped or halted. As a result, the adsorbed harmful components are purged with high reliability.

Now, a fifth preferred embodiment of the present invention will be described hereinbelow.

The fifth preferred embodiment differs from the first preferred embodiment in that the start and the finish of the purge are determined based on the output voltage VOX2 of the $O_2$ sensor 27, without deriving the total adsorption amount OST in the three-way catalytic converter 13.

The following description manly refers to the difference over the first preferred embodiment.

Figure 26:
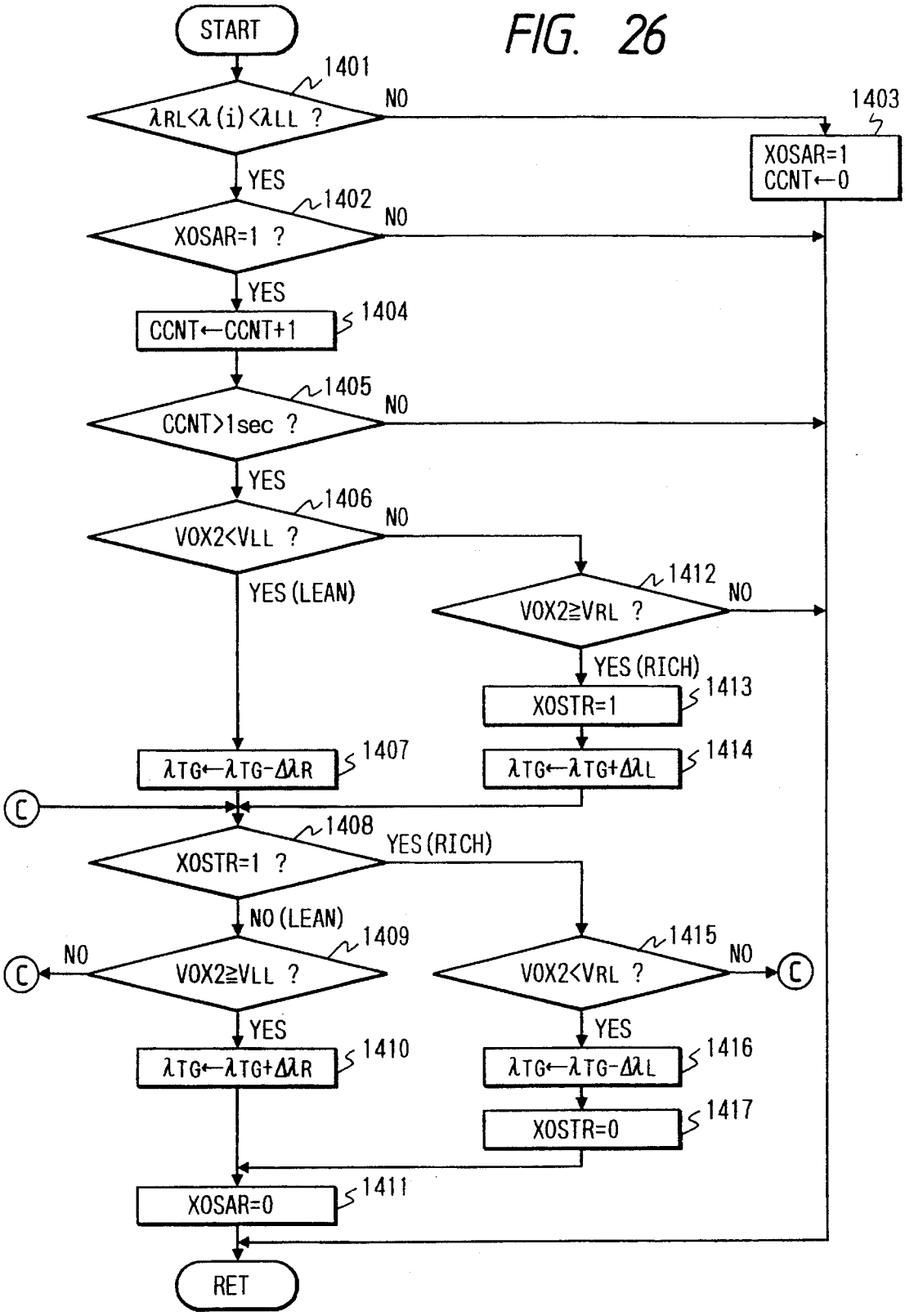
FIG. 26 is a flowchart of a purge control routine according to a fifth preferred embodiment of the present invention.

FIG. 26 shows a flowchart of a purge control routine according to the fifth preferred embodiment. The routine of FIG. 26 is executed in place of the routines of FIGS. 4 and 10 in the first preferred embodiment.

Now, it is assumed that the air-fuel ratio λ upstream of the three-way catalytic converter 13 is substantially stable and converges to near the stoichiometric air-fuel ratio λ=1. A step 1401 determines whether the air-fuel ratio λ(i) detected by the A/F sensor 26 is converged within a range defined by a preset rich-side limit value λRL and a preset lean side limit value λLL (λRL<λ=<λLL). Since the step 1401 produces a positive answer this time, the routine proceeds to a step 1402 which checks whether an air-fuel ratio deviation flag XOSAR is set. The air-fuel ratio deviation flag XOSAR, when it is set, represents that the air-fuel ratio λ is largely deviated or fluctuated. Since the air-fuel ratio deviation flag XOSAR is cleared, this routine is terminated. Specifically, when the air-fuel ratio λ is converged to near the stoichiometric air-fuel ratio λ=1, it is considered that the adsorption mount of the harmful components is small so as not to affect the adsorption capability of the three-way catalytic converter 13. As a result, the purge is not performed.

On the other hand, when the air-fuel ratio λ on the upstream side is largely deviated, the routine proceeds from the step 1401 to a step 1403 which sets the air-fuel ratio deviation flag XOSAR and resets a waiting time counter CCNT. Accordingly, when the air-fuel ratio λ is gain converged to near the stoichiometric air-fuel ratio λ=1, the step 1402 produces a positive answer this time since the air-fuel ratio deviation flag XOSAR is set at the step 1403. Then, the routine proceeds to a step 1404 which increases the waiting time counter CCNT by "1". Subsequently, a step 1405 determines whether a value of the waiting time counter CCNT has reached (1) second. If answer at the step 1405 is positive, the routine proceeds to a step 1406 as determining that the air-fuel ratio λ is sufficiently stable to enable the execution of the purge. The step 1406 determines whether the output voltage VOX2 of the $O_2$ sensor 27 is smaller than a preset lean side limit value VLL.

Figure 27:
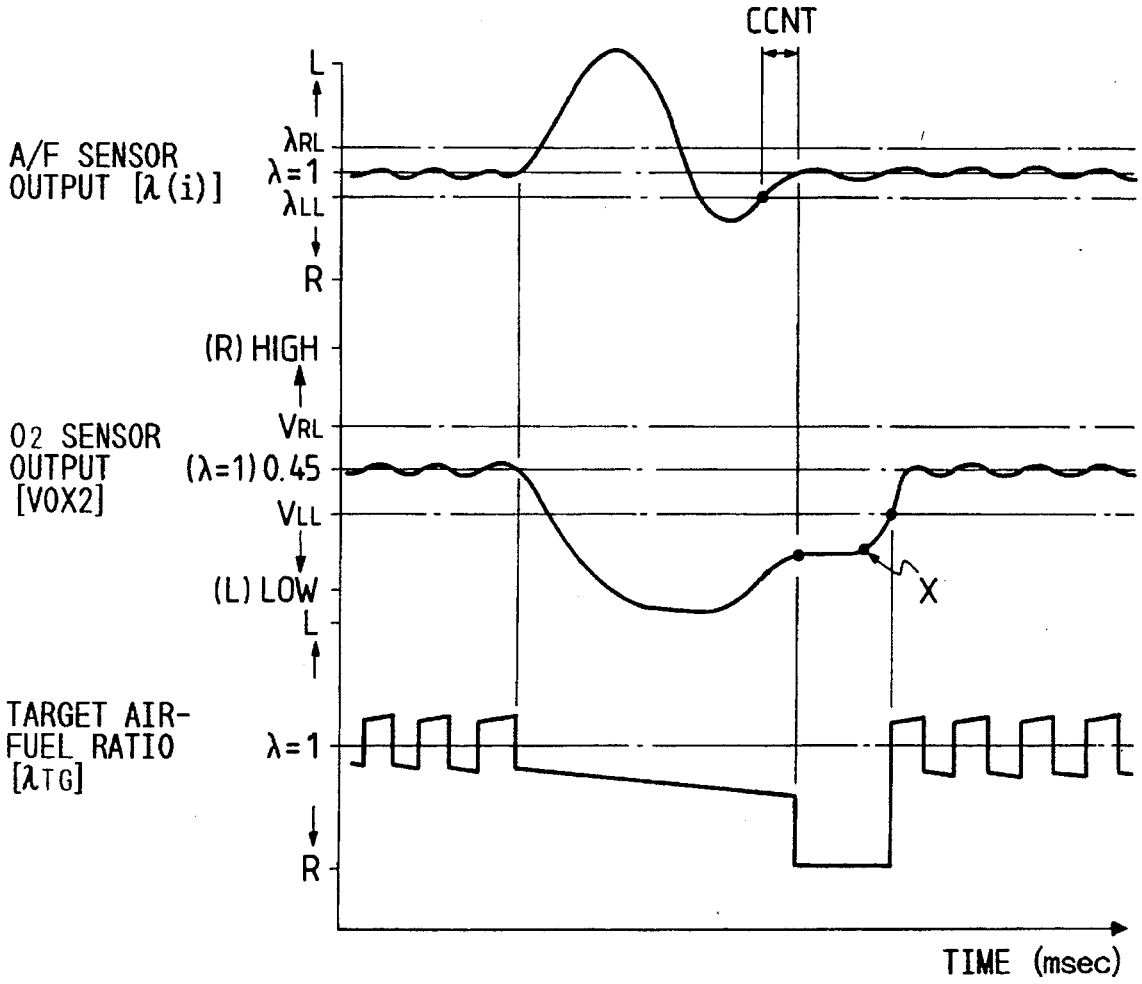
FIG. 27 is a time chart showing a relation among the output of the air-fuel ratio sensor, the output of the $O_2$ sensor and the target air-fuel ratio during the purge control of FIG. 26.

As described in the third preferred embodiment, the air-fuel ratio λ on the downstream side detected by the $O_2$ sensor 27 reveals a reliable value in comparison with the air-fuel ratio λ on the upstream side detected by the A/F sensor 26. Accordingly, it is possible to presume or estimate the adsorbing condition of the harmful components to the three-way catalytic converter 13 based on the air-fuel ratio λ detected by the $O_2$ sensor 27. As shown in FIG. 27, when the output voltage VOX2 of the $O_2$ sensor 27 is less than the lean side limit value VLL at the step 1406, it is estimated that the harmful components on the lean side, such as, NOx are absorbed in the three-way catalytic converter 13 due to the deviation of the air-fuel ratio λ to the lean side. Accordingly, a step 1407 corrects the target air-fuel ratio λTG to the rich side (λTG←λTG−ΔλR) so as to execute the purge. As a result, the adsorption amount in the three-way catalytic converter 13 is reduced, and thereby, the output voltage VOX2 gradually approaches to 0.45 V corresponding to the stoichiometric air-fuel ratio λ=1.

The routine now proceeds to a step 1408 which determines whether an adsorption amount rich flag XOSTR is set. The adsorption amount rich flag XOSTR, when it is set, represents that the air-fuel ratio λ before the correction of the target air-fuel ratio λTG is rich. Since the adsorption amount rich flag XOSTR is not set, the routine proceeds to a step 1409 which determines whether the output voltage VOX2 becomes equal to or greater than the lean side limit value VLL. When the output voltage VOX2 becomes equal to or greater than the lean side limit value VLL at the step 1409, a step 1410 returns the target air-fuel ratio λTG to the value before the correction at the step 1407 (λTG←λTG+ΔλR) so as to finish the purge. Subsequently, the routine proceeds to a step 1411 which clears the air-fuel ratio deviation flag XOSAR, and is terminated.

On the other hand, when the output voltage VOX2 is equal to or greater than the lean side limit value VLL at the step 1406, the routine proceeds to a step 1412 which determines whether the output voltage VOX2 is equal to or greater than a rich side limit value VRL. When the output voltage VOX2 is less than the rich side limit value VRL, i.e. the output voltage VOX2 is between the lean side limit value VLL and the rich side limit value VRL, this routine is terminated without executing the purge, as determining that the adsorption amount of the harmful components is small so as not to affect the adsorption capability of the three-way catalytic converter 13.

On the other hand, when the output voltage VOX2 is equal to or greater than the rich side limit value VRL at the step 1412, a step 1413 sets the adsorption amount rich flag XOSTR, and a step 1414 corrects the target air-fuel ratio λTG to the lean side (λTG←λTG+ΔλL) so as to execute the purge. Then, the routine proceeds via the step 1408 to a step 1415. When the output voltage VOX2 becomes less than the rich side limit value VRL at the step 1415, a step 1416 returns the target air-fuel ratio λTG to the value before the correction at the step 1414 (λTG←λTG−ΔλL) so as to finish the purge. Subsequently, a step 1417 clears the adsorption amount rich flag XOSTR. The routine further proceeds to the step 1411 which clears the air-fuel ratio deviation flag XOSAR, and is terminated. Through this purge control routine, the adsorption amount in the three way catalytic converter 13 is finally reduced to substantially 0 (zero).

As described above, in this preferred embodiment, when the air-fuel ratio λ is deviated, not only the air-fuel ratio λ is converged to the stoichiometric air-fuel ratio λ=1, but also the target air-fuel ratio λTG is set on a side opposite to a direction of the deviation of the air-fuel ratio λ so as to purge the harmful components adsorbed to the three-way catalytic converter 13 due to the deviation of the air-fuel ratio λ, as in the first preferred embodiment. Accordingly, the three-way catalytic converter 13 is always held at its maximum adsorption capability so as to securely adsorb the harmful components at the time of subsequent deviation of the air-fuel ratio λ so that the purification efficiency is significantly improved.

Further, since the start and the finish of the purge are respectively determined based on the output voltage VOX2 of the $O_2$ sensor 27 which varies depending on the adsorbing condition of the harmful components to the three-way catalytic converter 13, it is not necessary to successively derive the total adsorption amount OST of the harmful components based on the air-fuel ratio λ on the upstream side, as opposed to the first preferred embodiment. Accordingly, the control routine can be simplified, leading to reduction in cost of the entire air-fuel ratio control system.

It is to be understood that this invention is not to be limited to the preferred embodiments and modifications described above, and that various changes and modifications may be made without departing from the spirit and scope of the invention as defined in the appended claims where the limitation "air-fuel ratio" should be interpreted as broad as possible at least as in the foregoing description.

For example, in the foregoing first to fourth preferred embodiments, the material concentration M(i) is derived based on the actual air-fuel ratio λ(i) at the steps 205, 403 and 901, and the adsorption amount OST(i) is derived as the product of the thus derived material concentration M(i) and the intake air quantity QA(i) at the steps 206, 404 and 902. However, this process can be simplified in various ways. For example, when the engine speed Ne and the intake air pressure PM which are bases for deriving the intake air quantity QA do not change largely, the material concentration M(i) itself may be regarded as the adsorption amount OST(i), without considering the intake air quantity QA. Further, as seen from FIG. 5, since the material concentration M(i) is determined from the air-fuel ratio λ(i), the air-fuel ratio λ(i) itself may be regarded as the adsorption amount OST(i). Accordingly, for example, in the first preferred embodiment, the sampled air-fuel ratio λ(i) is added one-by-one to derive the sum at the step 207 in the routine of FIG. 4, and the air-fuel ratio λ(i) is subtracted one-by one-from the sum at the step 405 in the purge control routine of FIG. 10 so as to determine the finish timing of the purge.

Further, in the foregoing first, third and fourth preferred embodiments, the derivation of the total adsorption amount OST of the harmful components is started when the step 202 determines that the air-fuel ratio λ(i) is not converged within the range between the rich side limit value λRL and the lean side limit value λLL. However, the derivation of the total adsorption amount OST may be started when the deviation of the air-fuel ratio λ is expected due to a delay of the air-fuel ratio control, such as, at the start of a vehicular acceleration.

Figure 28:
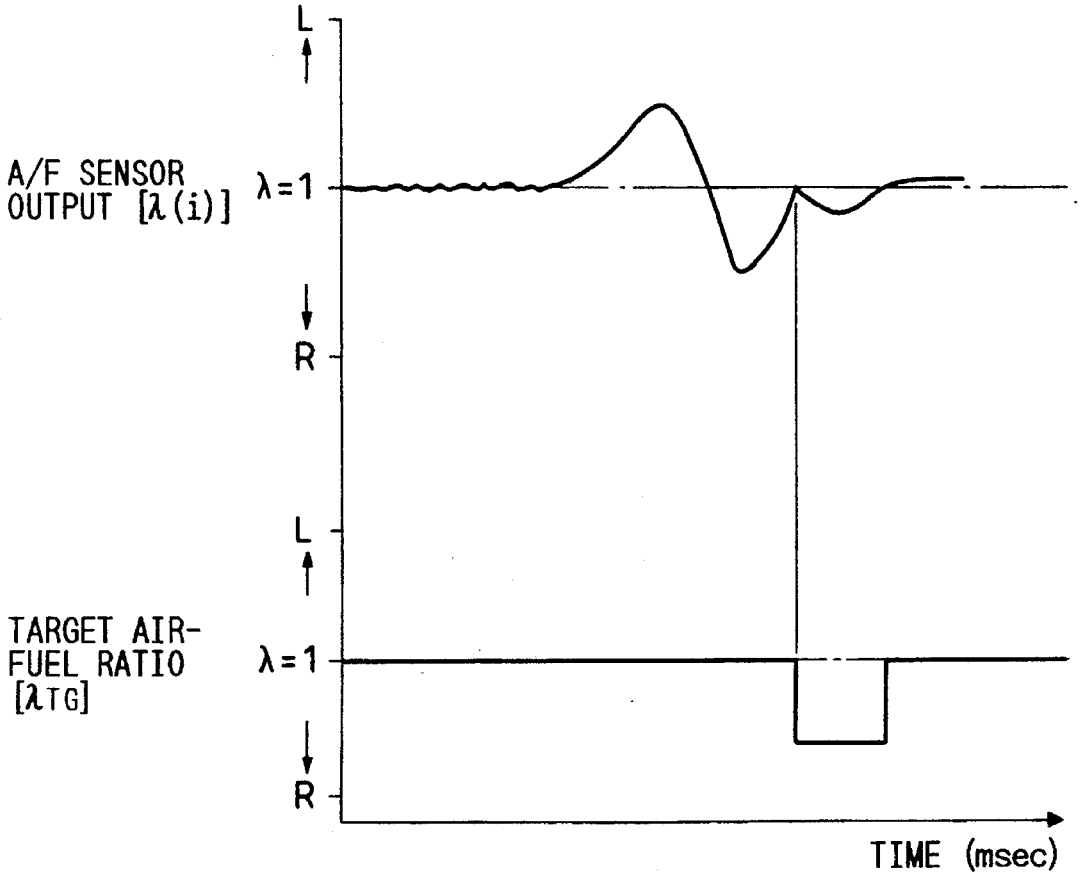
FIG. 28 is a time chart showing a relation between the output of the air-fuel ratio sensor and the target air-fuel ratio in a modification, wherein the purge control is started just after termination of deviation of the air-fuel ratio.

Still further, in the foregoing first, third and fourth preferred embodiments, the purge control is started when the sapling time Tα has elapsed at the step 204. However, for example, in case the derivation of the total adsorption mount OST is started at the start of the vehicular acceleration as described above, the purge control may be started when the acceleration is finished. Further, in the air-fuel ratio control described with reference to FIG. 2, i.e. the so-called modern control, when converging the air-fuel ratio λ deviated to the rich or lean side to the stoichiometric air-fuel ratio λ=1, the air-fuel ratio λ tends to be once controlled to the opposite side. Accordingly, the purge control may be started just after termination of such deviation as shown in FIG. 28. In this case, since the air-fuel ratio λ was controlled in the opposite direction, the purge of the harmful components has been effected to a certain degree before the start of the purge control. Accordingly, a balance of the total adsorption amounts OST should be derived so as to purge that balance.

Further, in the foregoing first, third and fourth preferred embodiments, the rich and lean purge correction mounts ΔλR, ΔλL for correcting the target air-fuel ratio λTG in the purge control are set fixed, and the execution time of the purge is adjusted by comparing the total adsorption mount OST and the rich or lean purge completion value OSTR, OSTL. However, the execution time of the purge may be fixed, and the correction amount for the target air-fuel ratio λTG may be variably set depending on a magnitude of the total adsorption amount OST to be purged. On the other hand, both the execution time of the purge and the correction amount for the target air-fuel ratio λTG may be set variably. Further, as the purge advances to reduce the absolute value of the total adsorption mount OST, the correction amount for the target air-fuel ratio λTG may be set to be gradually smaller so as to gradually approach the total adsorption amount OST to 0 (zero).

Further, in the foregoing first to fifth preferred embodiments, the target air-fuel ratio λTG derived in the inversion skip control or the purge control is directly used for deriving the air-fuel ratio correction coefficient FAF. However, for example, as in the air-fuel ratio control system disclosed in Japanese First (unexamined) Patent Publication No. 3-185244, the so-called dither control may be performed to periodically fluctuate the target air-fuel ratio λTG with respect to the derived value.

Still further, in the foregoing fourth preferred embodiment, the step 1301 or 1302 determines before the start of executing the purge whether a direction of the purge is correct or wrong, and the step 1303 or 1304 determines during the execution of the purge whether a direction of the purge is correct or wrong. However, it is not necessarily required to execute both determination processes. Accordingly, it may be arranged to execute the determination process only before the start of executing the purge or during the execution of the purge.

Further, in the foregoing fifth preferred embodiment, the purge is finished when the output voltage VOX2 of the $O_2$ sensor 27 becomes equal to or greater than the lean side limit value VLL at the step 1409, or when the output voltage VOX2 becomes smaller than the rich side limit value VRL at the step 1415. Specifically, a preset threshold value (VLL, VRL) is used to determine the timing of the finish of the purge. However, various other determination methods may be applied as long as the determination is made based on an approaching condition of the output voltage VOX2 toward 0.45 V corresponding to the stoichiometric air-fuel ratio λ=1. For example, the purge may be finished at a time point X in FIG. 27 when the output voltage VOX2 starts varying toward 0.45 V. Accordingly, the determination may also be made based on a direction of variation of the output voltage VOX2.

What is claimed is:

1. An air-fuel ratio control system for an internal combustion engine, comprising:

air-fuel ratio detecting means, provided upstream of a catalytic converter in an exhaust passage of the engine, for sequentially detecting air-fuel ratios of an air-fuel mixture based on exhaust gas upstream of the catalytic converter;

deviation condition determining means for integrating deviations of the detected air-fuel ratios with respect to a stoichiometric air-fuel ratio to derive a sum of the deviations of the detected air-fuel ratios when a given condition is satisfied;

target air-fuel ratio setting means, based on said sum of the deviations derived by said deviation condition determining means, for setting a target air-fuel ratio on a side opposite to a direction of said sum of the deviations in such a manner as to counterbalance said sum of the deviations, said target air-fuel ratio setting means restoring said target air-fuel ratio to a value before said setting when said sum of the deviations is counterbalanced to a given extent; and fuel injection amount adjusting means for adjusting a fuel injection amount of a fuel injection valve based on the target air-fuel ratio which is set by said target air-fuel ratio setting means.

2. The air-fuel ratio control system as set forth in claim 1, wherein said sum of the deviations represents an amount of a particular component absorbed in said catalytic converter, said particular component included in the exhaust gas.

3. The air-fuel ratio control system as set forth in claim 2, wherein said target air-fuel ratio setting means sets said target air-fuel ratio so as to counterbalance said absorbed amount of the particular component in said catalytic converter.

4. The air-fuel ratio control system as set forth in claim 1, wherein said deviation condition determining means includes:

downstream-side air-fuel ratio detecting means, provided downstream of said catalytic converter, for detecting an air-fuel ratio of the air-fuel mixture based on the exhaust gas having passed through the catalytic converter; and air-fuel ratio learning means for learning said upstream-side air-fuel ratio detected by said upstream-side air-fuel ratio detecting means as a stoichiometric air-fuel ratio when said downstream-side air-fuel ratio detected by said downstream-side air-fuel ratio detecting means is near the stoichiometric air-fuel ratio, and for correcting said upstream-side air-fuel ratio based on a result of said learning, said corrected upstream-side air-fuel ratio used by said target air-fuel ratio setting means to derive said target air-fuel ratio.

5. The air-fuel ratio control system as set forth in claim 1, wherein said target air-fuel ratio setting means includes:

downstream-side air-fuel ratio detecting means, provided downstream of said catalytic converter, for detecting an air-fuel ratio of the air-fuel mixture based on the exhaust gas having passed through the catalytic converter; and setting suspension means for determining, based on said downstream-side air-fuel ratio detected by said downstream-side air-fuel ratio detecting means, whether a setting direction of the target air-fuel ratio is correct, and for suspending said setting of the target air-fuel ratio when said setting direction is wrong.

6. The air-fuel ratio control system as set forth in claim 5, wherein said setting suspension means suspends the setting of the target air-fuel ratio by comparing said detected downstream-side air-fuel ratio with a preset rich side limit value or a preset lean side limit value.

7. An air-fuel ratio control system for an internal combustion engine, comprising:

air-fuel ratio detecting means, provided upstream of a catalytic converter in an exhaust passage of the engine, for sequentially detecting air-fuel ratios of an air-fuel mixture based on exhaust gas upstream of the catalytic converter;

deviation condition determining means for integrating deviations of the detected air-fuel ratios with respect to a stoichiometric air-fuel ratio to derive a sum of the deviations of the detected air-fuel ratios and for determining whether said sum of the deviations exceeds a preset rich-side limit value or a preset lean-side limit value;

target air-fuel ratio setting means for setting a target air-fuel ratio to a lean-side target value which is leaner than the stoichiometric air-fuel ratio when said sum of the deviations exceeds said rich-side limit value and to a rich-side target value which is richer than the stoichiometric air-fuel ratio when said sum of the deviations exceeds said lean-side limit value; and fuel injection amount adjusting means for adjusting a fuel injection amount of a fuel injection valve based on the target air-fuel ratio which is set by said target air-fuel setting means.

8. The air-fuel ratio control system as set forth in claim 7, wherein said sum of the deviations represents an amount of a particular component adsorbed in said catalytic converter, and wherein said deviation condition determining means determines whether said absorbed amount exceeds said rich or lean-side limit value.

9. An air-fuel ratio control system for an internal combustion engine, comprising:

downstream-side air-fuel ratio detecting means, provided downstream of a catalytic converter in an exhaust passage of the engine, for sequentially detecting air-fuel ratios of an air-fuel mixture based on exhaust gas having passed through said catalytic converter;

target air-fuel ratio setting means for determining a deviation direction of the detected downstream-side air-fuel ratio with respect to a stoichiometric air-fuel ratio, and for setting a target air-fuel ratio on a side opposite to said deviation direction across the stoichiometric air-fuel ratio so as to counterbalance a deviation of said detected downstream-side air-fuel ratio with respect to the stoichiometric air-fuel ratio, said target air-fuel ratio setting means restoring said target air-fuel ratio to a value before said setting when said deviation of the detected downstream-side air-fuel ratio is counterbalanced to a given extent; and fuel injection amount adjusting means for adjusting a fuel injection amount of a fuel injection valve based on the target air-fuel ratio which is set by said target air-fuel ratio setting means.

10. The air-fuel ratio control system as set forth in claim 9, wherein said target air-fuel ratio setting means performs said setting when the detected downstream side air-fuel ratio is outside a range defined by a preset rich-side limit value and a preset lean-side limit value, and performs said restoration when the detected downstream side air-fuel ratio falls within said range.

11. The air-fuel ratio control system as set forth in claim 1, wherein the deviation of the detected air-fuel ratio to a rich side with respect to the stoichiometric air-fuel ratio and the deviation of the detected air-fuel ratio to a lean side with respect to the stoichiometric air-fuel ratio are assigned opposite signs so that said sum of the deviations represents an amount of a particular component adsorbed in said catalytic converter, said particular component included in the exhaust gas.

12. The air-fuel ratio control system as set forth in claim 7, wherein the deviation of the detected air-fuel ratio to a rich side with respect to the stoichiometric air-fuel ratio and the deviation of the detected air-fuel ratio to a lean side with respect to the stoichiometric air-fuel ratio are assigned opposite signs so that said sum of the deviations represents an amount of a particular component adsorbed in said catalytic converter, said particular component included in the exhaust gas.

* * * * *